US012018417B2

(12) United States Patent
Minematsu et al.

(10) Patent No.: US 12,018,417 B2
(45) **Date of Patent: *Jun. 25, 2024**

(54) SEWING MACHINE

(71) Applicant: BROTHER KOGYO KABUSHIKI KAISHA, Nagoya (JP)

(72) Inventors: Yoshihiro Minematsu, Nagoya (JP); Yoko Yamanashi, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/188,135

(22) Filed: Mar. 22, 2023

(65) Prior Publication Data

US 2023/0220597 A1 Jul. 13, 2023

Related U.S. Application Data

(63) Continuation of application No. 17/349,413, filed on Jun. 16, 2021, now Pat. No. 11,634,846, which is a continuation of application No. 16/460,484, filed on Jul. 2, 2019, now Pat. No. 11,060,221.

(30) Foreign Application Priority Data

Jul. 3, 2018 (JP) ..... 2018-126874

(51) Int. Cl.

| | |
|---|---|
| ***D05B 79/00*** | (2006.01) |
| ***D05B 19/08*** | (2006.01) |
| ***D05B 19/10*** | (2006.01) |
| ***D05B 19/12*** | (2006.01) |
| ***D05B 19/16*** | (2006.01) |
| ***D05B 35/12*** | (2006.01) |

(52) U.S. Cl.

CPC ..... *D05B 19/12* (2013.01); *D05B 19/08* (2013.01); *D05B 19/10* (2013.01); *D05B 19/16* (2013.01); *D05B 35/12* (2013.01); *D05B 79/00* (2013.01); *D05D 2205/085* (2013.01); *D05D 2205/18* (2013.01)

(58) Field of Classification Search

CPC ..... D05B 79/00; D05B 19/16; D05B 21/00; D05C 5/02

See application file for complete search history.

(56) References Cited

U.S. PATENT DOCUMENTS

| | | | |
|---|---|---|---|
| 5,072,680 | A | 12/1991 | Nakashima |
| 5,195,451 | A | 3/1993 | Nakashima |
| 5,323,722 | A | 6/1994 | Goto et al. |
| 6,161,491 | A | 12/2000 | Takenoya et al. |
| 7,212,880 | B2 | 5/2007 | Mizuno et al. |
| 8,738,168 | B2 | 5/2014 | Naka et al. |

(Continued)

FOREIGN PATENT DOCUMENTS

JP H05-269278 A 10/1993

*Primary Examiner* — Tajash D Patel
(74) *Attorney, Agent, or Firm* — Oliff PLC

(57) ABSTRACT

A sewing machine determines a pattern from multiple patterns, as a first pattern. The sewing machine generates a projection image including a first image representing a sewing image of the first pattern in a sewing expected size thereof. The sewing machine projects the generated projection image onto a projection area. The sewing machine sews the first pattern on a workpiece in the sewing expected size based on pattern data for the first pattern.

14 Claims, 12 Drawing Sheets

(56) References Cited

U.S. PATENT DOCUMENTS

| | | | | |
|---|---|---|---|---|
| 9,302,404 | B2 | 4/2016 | Matsushima et al. | |
| 9,650,734 | B2 | 5/2017 | Elliott et al. | |
| 9,739,000 | B2 | 8/2017 | Shimizu et al. | |
| 10,934,649 | B2 | 3/2021 | Matsushima | |
| 11,060,221 | B2 | 7/2021 | Minematsu et al. | |
| 11,634,846 | B2 * | 4/2023 | Minematsu ..... | D05B 19/08<br>112/102.5 |
| 2021/0356849 | A1 | 11/2021 | McNeeley et al. | |

* cited by examiner

SEWING MACHINE

CROSS-REFERENCE TO RELATED APPLICATION

This application is a continuation of U.S. patent application Ser. No. 17/349,413, filed Jun. 16, 2021, which is a continuation of U.S. patent application Ser. No. 16/460,484, filed Jul. 2, 2019, which claims priority from Japanese Patent Application No. 2018-126874 filed on Jul. 3, 2018, the content of which is incorporated herein by reference in its entirety.

TECHNICAL FIELD

Aspects described herein relate to a sewing machine.

BACKGROUND

A known sewing machine includes a projector that projects an image of an embroidery pattern to be sewn, onto a workpiece held by a hoop.

SUMMARY

The sewing machine is configured to sew utility stitch patterns and decorative stitch patterns that do not require a hoop during sewing. A utility stitch pattern or a decorative stitch pattern includes pieces of a design arranged sequentially or repeatedly in a feeding direction in which a workpiece is fed by a feed dog. The design includes a plurality of line segments, at least one of which extends in a direction crossing the feeding direction.

One or more aspects described herein provide a sewing machine that provides an increased convenience to a user for sewing a utility stitch pattern or a decorative stitch pattern.

According to one or more aspects described herein, a sewing machine may comprise a bed; a feed unit including a feed dog disposed at the bed, the feed unit configured to drive the feed dog to feed a workpiece in a feeding direction; a sewing unit including a needle bar, the sewing unit configured to form stiches by moving a needle held by the needle bar up and down relative to the workpiece fed by the feed unit, the stitches representing a pattern including pieces of a design that are repeatedly arranged in the feeding direction, the design including a plurality of line segments, at least one of which extends in a direction crossing the feeding direction; a projector configured to project a projection image onto a projection area on the bed, and a controller configured to control the feed unit, the sewing unit, and the projector. The controller may be configured to perform steps comprising: determining a pattern from multiple patterns, as a first pattern; generating the projection image including a first image representing a sewing image of the first pattern in a sewing expected size thereof, the first image being located toward an upstream side in the feeding direction from a position corresponding to a needle drop position of the needle bar in the feeding direction; causing the projector to project the generated projection image onto the projection area; and controlling the feed unit and the sewing unit to sew the first pattern on the workpiece in the sewing expected size based on pattern data for the first pattern.

The sewing machine includes the feed unit configured to feed a workpiece with the feed dog, and is configured to project a projection image representing a pattern including pieces of a design that are sequentially or repeatedly arranged in the feeding direction. The design includes a plurality of line segments at least one of which extends in a direction crossing the feeding direction. The sewing machine may allow a user to preview or check before sewing, a sewing image projected in the sewing expected size. The sewing machine may thus provide increased convenience to a user who sews stitch patterns.

DETAILED DESCRIPTION

Figure 1:
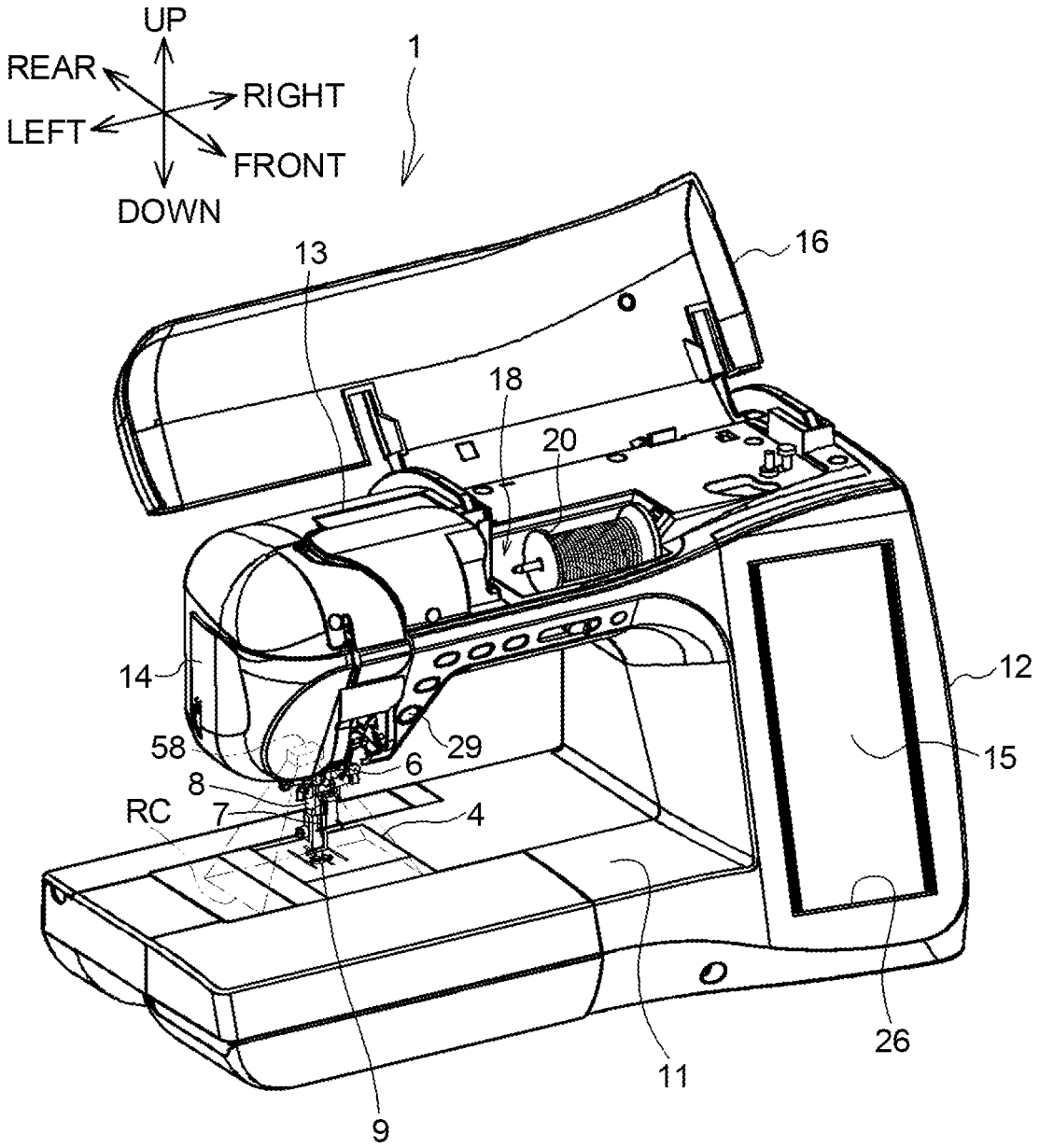
FIG. 1 is a perspective view of a sewing machine in an illustrative embodiment according to one or more aspects of the disclosure.
Figure 2:
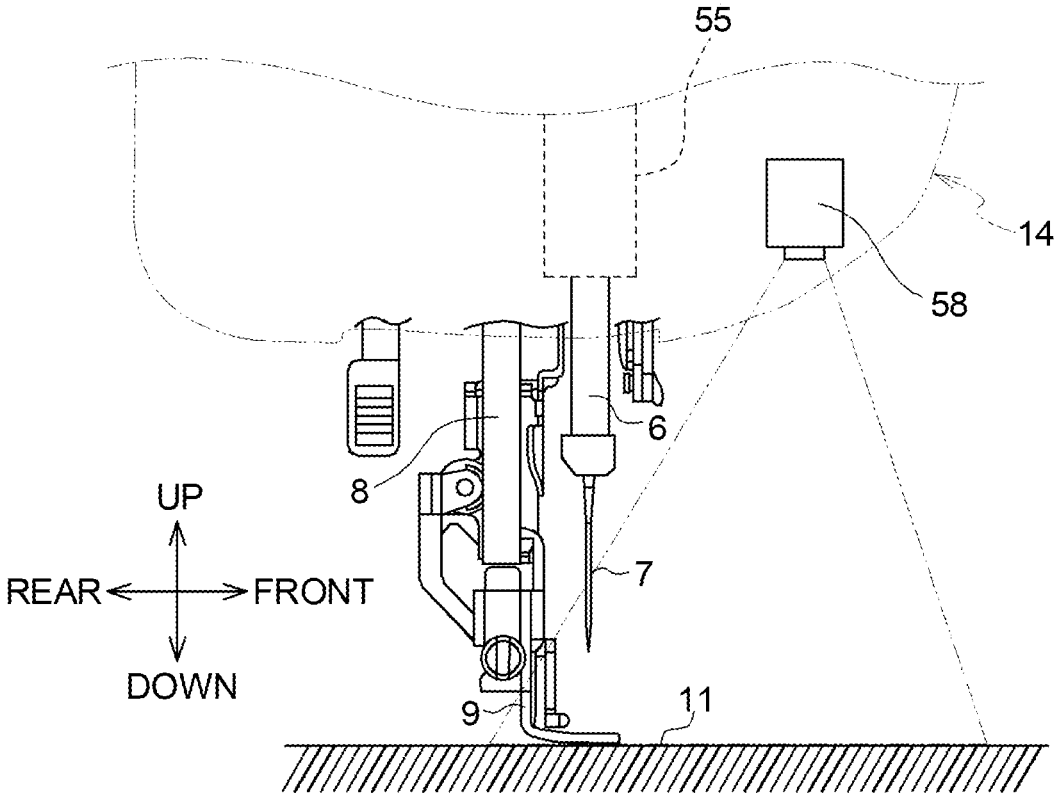
FIG. 2 is a diagram illustrating a configuration of a lower portion of a head of the sewing machine.
Figure 3:
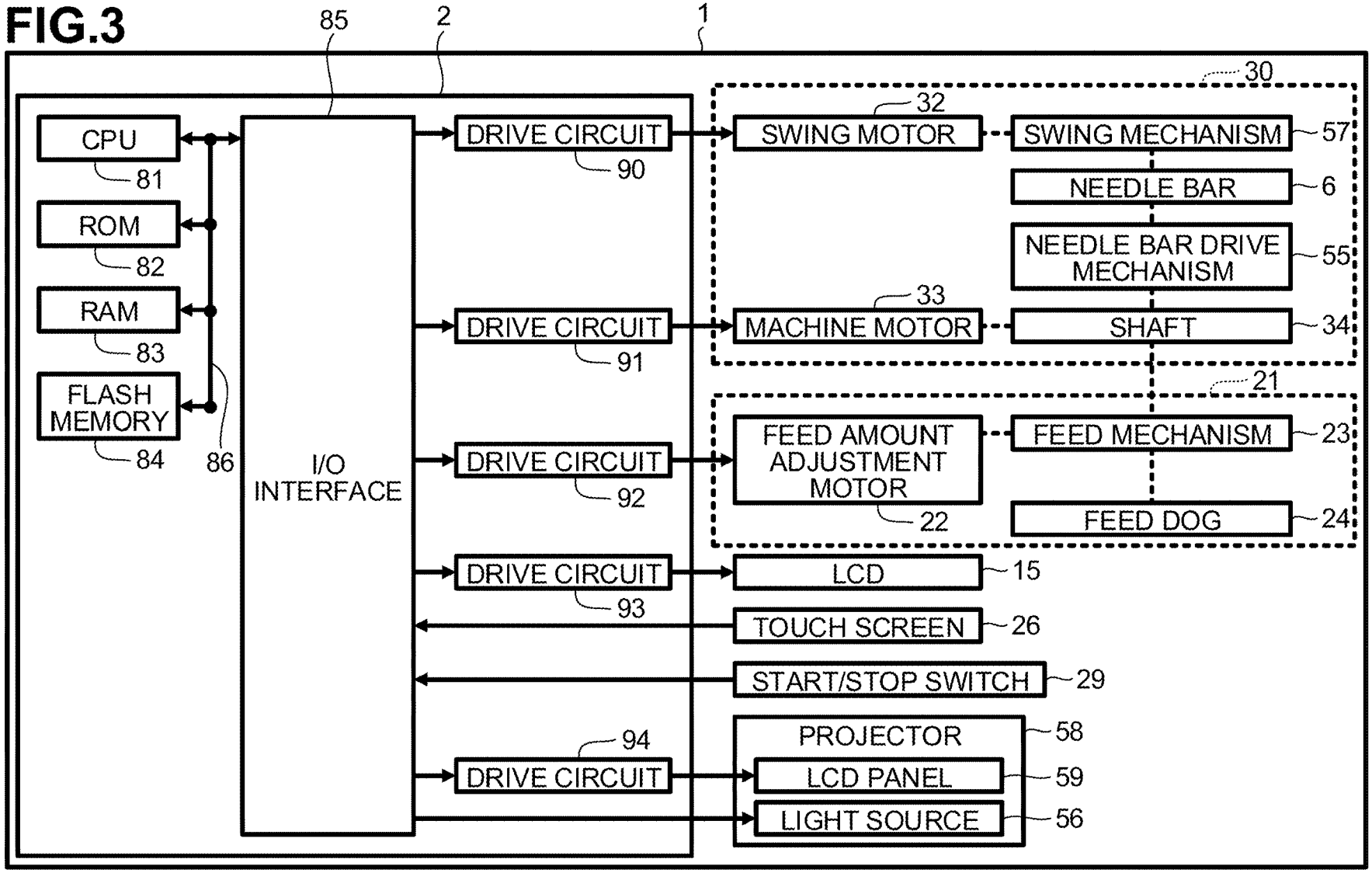
FIG. 3 is block diagram illustrating an electrical configuration of the sewing machine.

An embodiment will be described with reference to the accompanying drawings. Referring to FIGS. 1 to 3, a configuration of a sewing machine 1 will be described. In the following description, directional terminology, such as "up/upper," "down/lower," "front," "rear," "left," "right" etc., as labeled in the drawings, may be used. In the page of FIG. 1, an upper side, a lower side, a lower right side, an upper left side, a lower left side, and an upper right side respectively correspond to an upper side, a lower side, a front side, a rear side, a left side, and a right side. A longitudinal direction of a bed 11 and a horizontal arm 13 corresponds to a left-right direction of the sewing machine 1. A side of the sewing machine 1 on which an upright arm 12 is disposed is the right side. A direction in which the upright arm 12 is elongated is an up-down direction of the sewing machine 1.

As depicted in FIG. 1, the sewing machine 1 includes the bed 11, the upright arm 12, the horizontal arm 13, and a head 14. The bed 11 is a base portion of the sewing machine 1, and extends in the left-right direction. The upright arm 12 extends upward from a right end portion of the bed 11. The horizontal arm 13 extends leftward from an upper end of the upright arm 12 and faces the bed 11. The head 14 is connected to a left end portion of the horizontal arm 13.

The bed 11 includes a needle plate 4 at an upper surface thereof. The needle plate 4 has a needle hole 3 (refer to FIG. 6C) that allows a needle 7 (described below) to pass therethrough. The sewing machine 1 includes a feed unit 21 (in FIG. 3), and a shuttle mechanism (not depicted) that are housed in the bed 11. The feed unit 21 includes a feed dog 24 disposed in the bed 11. The feed unit 21 further includes a feed mechanism 23 configured to drive the feed dog 24 to feed a workpiece C by a predetermined amount. The feed unit 21 is configured to feed the workpiece C in a feeding direction or a first direction (e.g., front-rear direction), as well as in a second direction (e.g., the left-right direction) orthogonal to the first direction, by driving the feed dog 24. The shuttle mechanism causes an upper thread (not depicted) to be entwined or intertwined with a lower thread (not depicted) underneath the needle plate 4.

A liquid crystal display ("LCD") 15 is disposed at a front surface of the upright arm 12. The LCD 15 is configured to display an image including various items, such as commands, illustration, settings, and messages. The LCD 15 includes a touch screen 26 on a front surface thereof. The touch screen 26 is configured to detect a position or a portion thereof pressed or touched by a user with his/her finger or a stylus (not depicted). Based on the position detected by the touch screen 26, an item selected on the image displayed in the LCD 15 is determined by a controller 2 (refer to FIG. 3) of the sewing machine 1. A user's operation of pressing or touching the touch screen 26 may be hereinafter referred to as a "panel operation". A user is allowed to select a pattern to be sewn from multiple patterns including utility stitch patterns and decorative stitch patterns, as well as a command to be executed, with a panel operation. A machine motor 33 (in FIG. 3) is disposed inside the upright arm 12.

A cover 16 is disposed at an upper portion of the horizontal arm 13. The cover 16 is configured to pivot between an open position and a closed position. FIG. 1 shows the cover 16 at the open position. A spool storage 18 is located below the cover 16 at the closed position (e.g., in a space defined in the horizontal arm 13). The spool storage 18 is configured to receive a spool 20 having the upper thread wound thereon. Inside the horizontal arm 13, a shaft 34 (refer to FIG. 3) extends in the left-right direction. The shaft 34 is configured to be rotated by the machine motor 33. Various switches, including a start/stop switch 29, are located at a lower left portion of the front surface of the horizontal arm 13. The start/stop switch 29 is used to input an instruction to start or stop an operation of the sewing machine 1, e.g., to start or stop sewing.

As depicted in FIGS. 2 and 3, the head 14 includes a sewing unit 30, a presser bar 8, and a projector 58. The sewing unit 30 includes a needle bar 6, and is configured to form stitches on a workpiece C (refer to FIG. 11E) by moving the needle bar 6 up and down. The needle bar 6 is located above the needle hole 3. The needle 7 is removably attachable to a lower end of the needle bar 6. The sewing unit 30 further includes the shaft 34, a needle bar drive mechanism 55, and a swing mechanism 57. The needle bar drive mechanism 55 is configured to drive the needle bar 6 in the up-down direction by the rotation of the shaft 34. A presser foot 9 is removably attachable to a lower end of the presser bar 8. The presser foot 9 is configured to move, together with the presser bar 8, between a lower position and an upper position. At the lower position, the presser foot 9 presses the workpiece C down. At the upper position, the presser foot 9 is located at a higher position than when the presser foot 9 is located at the lower position, and is spaced from the workpiece C. The presser foot 9 is configured to intermittently press the workpiece C down in association with the up-down movement of the needle bar 6.

The swing mechanism 57 includes a known mechanism configured to move the needle bar 6 in the left-right direction with drive force from a swing motor 32. The needle bar 6 may move or swing within a particular moving range. The center of the particular moving range in its width/lateral direction may be referred to as a center needle drop position. The left end and the right end of the particular moving range in its width/lateral direction may be, respectively, referred to as a left needle drop position and a right needle drop position. The particular moving range may be determined appropriately based on a configuration of the swing mechanism 57. The particular moving range may be, for example, 7 mm. A distance or a length from the left needle drop position to the center needle drop position may be 3.5 mm. A distance or a length from the center needle drop position to the right needle drop position may also be 3.5 mm.

The projector 58 is configured to project an image to a projection area RC on the bed 11. The projection area RC may include a needle drop position located below the needle bar 6. The projection area RC may be elongated in the left-right direction. The projector 58 includes a cylindrical casing in which a LCD panel 59 (refer to FIG. 3), a light source 56 (refer to FIG. 3), and an image forming lens (not depicted) are disposed. The casing of the projector 58 is located in the head 14 and is fixed to a machine casing. The light source 56 may be a LED. The LCD panel 59 is configured to modulate the light from the light source 56 and form image beams for a projection image to be projected onto the projection area RC, based on image data representing the projection image. The image forming lens uses the image beams formed by the LCD panel 59 to form an image in the projection area RC on the bed 11. In the illustrative embodiment, the projector 58 is configured to project a projection image, from diagonally above, onto the workpiece C on the bed 11. The projection image is subjected to processing to correct image distortions. In the illustrative embodiment, the flash memory 84 stores the size (e.g., a number of vertical dots×horizontal dots) of a projection image to be projected by the projector 58. An image projected on the bed 11, e.g., the projection area RC, may have, for example, a length of approximately 12.7 cm and a width of approximately 7.6 cm.

Referring to FIG. 3, an electrical configuration of the sewing machine 1 will now be described. The sewing machine 1 includes the controller 2 that includes a CPU 81, a ROM 82, a RAM 83, the flash memory 84, an input/output ("I/O") interface 85, and drive circuits 90-94. The CPU 81 is connected to the ROM 82, the RAM 83, the flash memory 84, and the I/O interface 85, via a bus 86.

The CPU 81 performs overall control of the sewing machine 1. The CPU 81 performs various calculations and processing relating to sewing, in accordance with programs stored in the ROM 82. The ROM 82 includes a plurality of storage areas (not depicted), including a program storage area. The program storage area stores therein various programs for operating the sewing machine 1. An example of the programs includes a program for executing main processing, which will be described in detail below.

The RAM 83 includes a storage area in which results of calculations performed by the CPU 81 is stored. The flash memory 84 stores therein various parameters to be used for performing the various processing by the sewing machine 1. The flash memory 84 stores therein pieces of pattern data of patterns including utility stitch patterns and decorative stitch patterns that the sewing machine 1 can sew. Pattern data for each pattern is stored in the flash memory 84 in association with a corresponding pattern ID. Each pattern may include at least one of utility stitch patterns and decorative stitch patterns, each of which is formed by sequentially or repeatedly sewing pieces of a design in the first direction in which the workpiece C is fed by the feed unit 21. The design includes a plurality of line segments, at least one of which extends in a direction crossing the first direction. In other words, the first direction corresponds to a direction in which pieces of a design are sequentially or repeatedly arranged. In the illustrative embodiment, the first direction on an upper surface of the bed 11 corresponds to a direction orthogonal to the longitudinal direction of the bed 11. The pattern data includes coordinate data. The coordinate data represents coordinates of needle drop positions of line segments constituting a pattern, relative to a reference position of the pattern. The reference position of the pattern may be, for example, a baseline position, which may be determined based on the moving range of the needle bar 6 configured to be moved by the swing mechanism 57. The reference position may be, for example, any one of a middle baseline CL, a left baseline, and a right baseline. In the illustrative embodiment, the reference position of a pattern is the middle baseline CL. Positions of the middle baseline CL, the left baseline, and the right baseline relative to one another are prestored in the flash memory 84. If any of the baseline positions is used as a reference position of a pattern, the controller 2 may determine coordinates of needle drop positions of a pattern relative to the middle baseline CL. The coordinate data in the illustrative embodiment, includes a group of data representing coordinates of each needle drop position relative to the middle baseline CL. To sew a pattern in accordance with the pattern data, the sewing machine 1 controls the sewing unit 30 and the feed unit 21, as well as the swing mechanism 57 to move the needle bar 6 at an appropriate position in the left-right direction. To move the workpiece C in the front-rear direction relative to the needle bar 6 for a pattern sewing in accordance with pattern data, the sewing machine 1 drives the feed unit 21, thereby moving the workpiece C in the first direction. To move the workpiece C in the left-right direction or the width direction relative to the needle bar 6 for a pattern sewing in accordance with pattern data, the sewing machine 1 may drive the swing mechanism 57 and/or the feed unit 21, thereby moving the workpiece C in the second direction. The pattern ID is an identifier that identifies a pattern. In the illustrative embodiment, the pattern ID includes a numeric character.

The flash memory 84 also stores a coordinate system of the projector 58 (hereinafter referred to as a "projected coordinate system") and a coordinate system of a whole space (hereinafter also referred to as a "world coordinate system") that are correlated to one another in advance using parameters stored in the flash memory 84. This may allow the sewing machine 1 to identify or determine coordinates of a pattern in the projected coordinate system based on pattern data. In the illustrative embodiment, the projection image is a colored image in a plurality of colors. In another embodiment, the projection image may be a monochrome image. The colors of the projection image may be adjusted according to the colors of the workpiece C. The I/O interface 85 is connected to the drive circuits 90-94, the touch screen 26, the start/stop switch 29, and the light source 56 of the projector 58. The light source 56 is configured to be turned on based on a control signal from the CPU 81 and project a projection image displayed on the LCD panel 59 onto the workpiece C, which may be placed on the bed 11.

The drive circuit 90 is connected to the swing motor 32. Based on a control signal from the CPU 81, the drive circuit 90 drives the swing motor 32. The drive circuit 91 is connected to the machine motor 33. Based on a control signal from the CPU 81, the drive circuit 91 drives the machine motor 33. Driving the machine motor 33 causes the needle bar drive mechanism 55 to be driven via the shaft 34, thereby moving the needle bar 6 up and down. The drive circuit 92 is connected to a feed amount adjustment motor 22. Based on a control signal from the CPU 81, the drive circuit 93 drives the LCD 15 to display an image on the LCD 15. Based on a control signal from the CPU 81, the drive circuit 94 drives the LCD panel 59 of the projector 58 to display a projection image on the LCD panel 59.

Referring to FIGS. 4-11E, the main processing of the sewing machine 1 will now be described. The main processing may be executed, based on an instruction from a user, to cause the projector 58 to project, on the workpiece C on the bed 11, a projection image representing sewing image(s) of a particular number of pattern(s) among the multiple patterns stored in the flash memory 84. The particular number of patterns may be, for example, three. One is a pattern selected by the user with the panel operation from the multiple patterns stored in the flash memory 84. The other two are the patterns whose pattern IDs are immediately before and after the pattern ID of the pattern selected by the user. The main processing may be started based on a user's panel operation for selecting a pattern. Based on determining that the main processing start has been instructed, the controller 2 reads out a program for executing the main processing stored in the program storage area of the ROM 82, into the RAM 83. The controller 2 executes the following steps based on the instructions included in the program read into the RAM 83. The flash memory 84 stores therein parameters required for performing the main processing. Various data obtained during the main processing may be stored in the RAM 83. In the following description, image data to be processed by the controller 2 may be simply referred to as an image or a projection image. The up-down direction in FIGS. 6A-6C and FIGS. 8A-11E corresponds to a Y direction, the feeding direction, or the first direction. The left-right direction in FIGS. 6A-6C and FIGS. 8A-11E corresponds to an X direction, the width direction, or the second direction.

Figure 4:
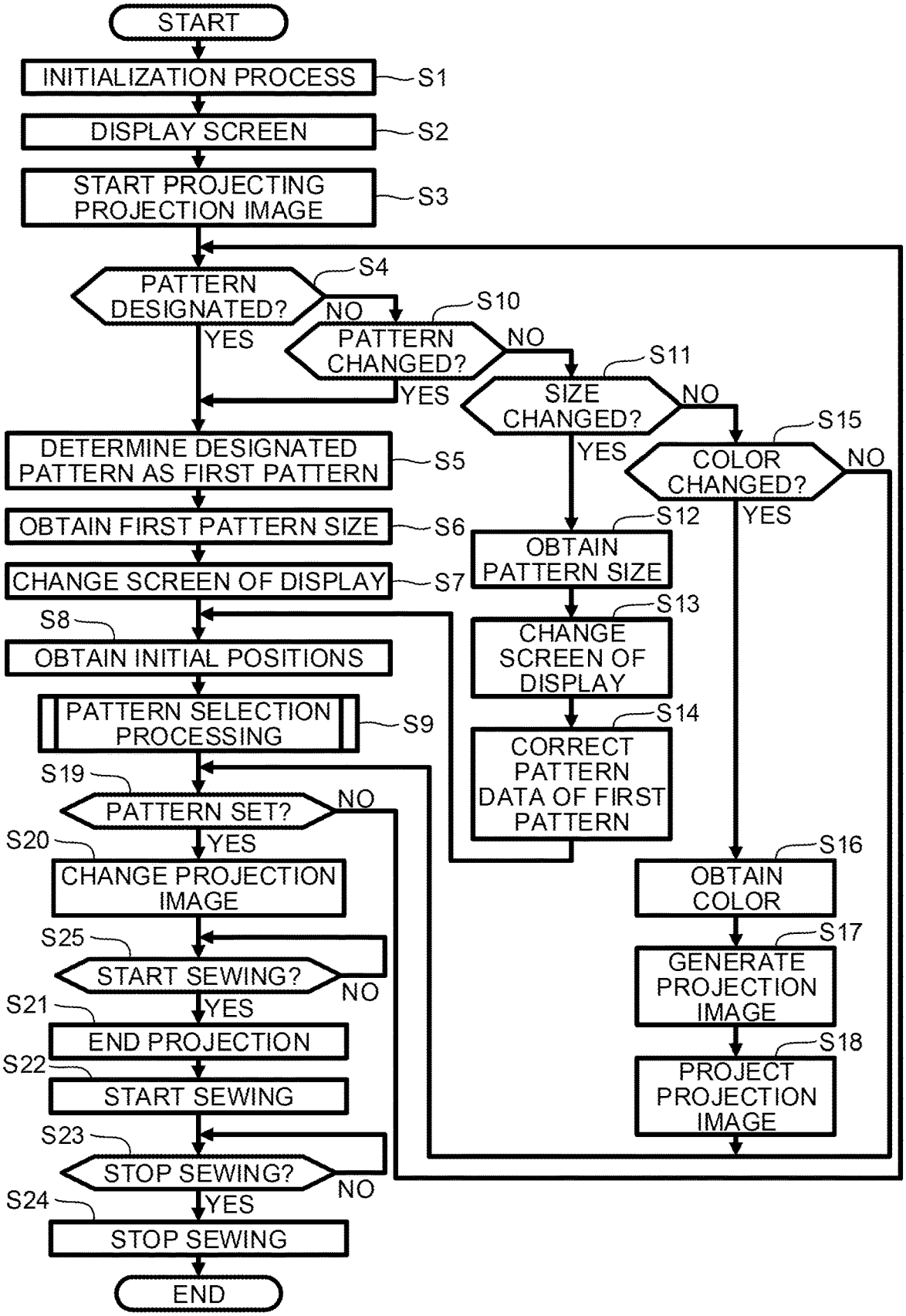
FIG. 4 is a flowchart of a main processing to be performed by the sewing machine.
Figure 5:
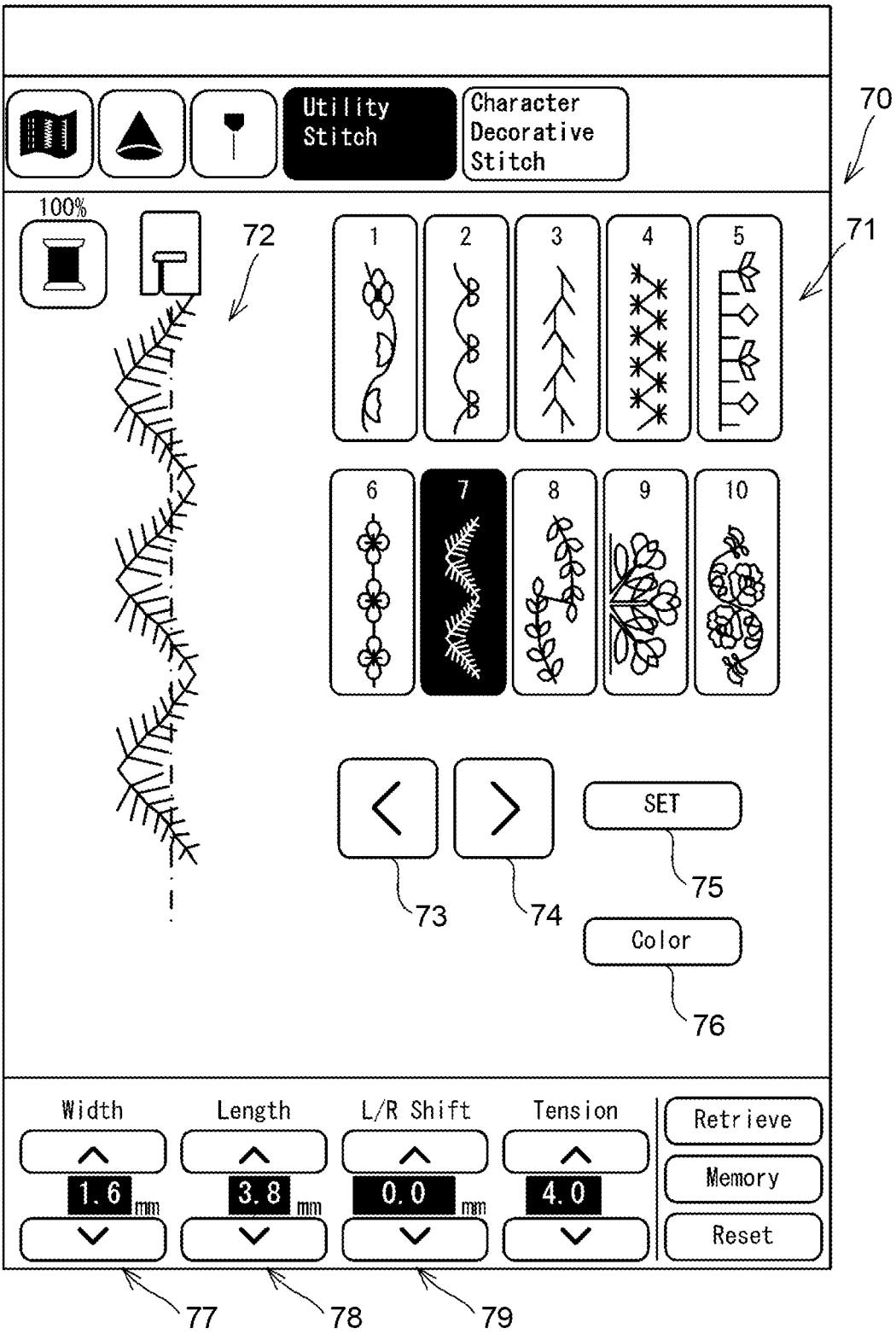
FIG. 5 illustrates an example of a screen displayed during the main processing.

As depicted in FIG. 4, the controller 2 executes an initialization process (S1), in which the controller 2 initializes, for example, various settings. The controller 2 controls or causes the LCD 15 to display a screen 70 including sewing images of some of the patterns stored in the flash memory 84 (S2). As depicted in FIG. 5, the screen 70 includes display sections 71 and 72 and input keys 73-79. The display section 71 may display sewing images of a predetermined number (e.g., ten) of patterns and their corresponding IDs, in the order of the number of the IDs. When the user selects one of the sewing images displayed in the display section 71, a background of the selected sewing image is displayed in a different color from backgrounds of unselected sewing images. The display section 72 shows a sewing image or a preview of the selected pattern. The screen 70 in FIG. 5 shows that a pattern E7 with it ID "7" has been selected. The input key 73 is used to input an instruction to select a pattern whose pattern ID is immediately before the pattern ID of the pattern currently being selected. The input key 74 is used to input an instruction to select a pattern whose pattern ID is immediately after the pattern ID of the pattern currently being selected. The input key 75 is used to input an instruction to set the pattern currently being selected as a pattern to be sewn. The input key 76 is used to input an instruction to change the color of the pattern being projected by the projector 58. The input key 77 is used to input an instruction to change a setting of a width (e.g., a dimension in the width direction) of the pattern currently being selected. The width direction corresponds to a direction orthogonal to the first direction (e.g., the front-rear direction) in which the workpiece C is fed by the feed unit 21. In other words, the width direction corresponds to the left-right direction and the second direction. The input key 78 is used to input an instruction to change a setting of a length (e.g., a dimension in the first direction) of the pattern being currently selected. The input key 79 is used to input an instruction to change a setting of a position, in the width direction, of the pattern being currently selected.

The controller 2 controls or causes the projector 58 to start projecting a projection image (S3). A projection image to be initially projected onto the bed 11 may be appropriately determined. For example, the projector 58 may project a projection image in which no pattern is included or a particular pattern (e.g., a pattern with its ID "1") is included.

Figure 6A:
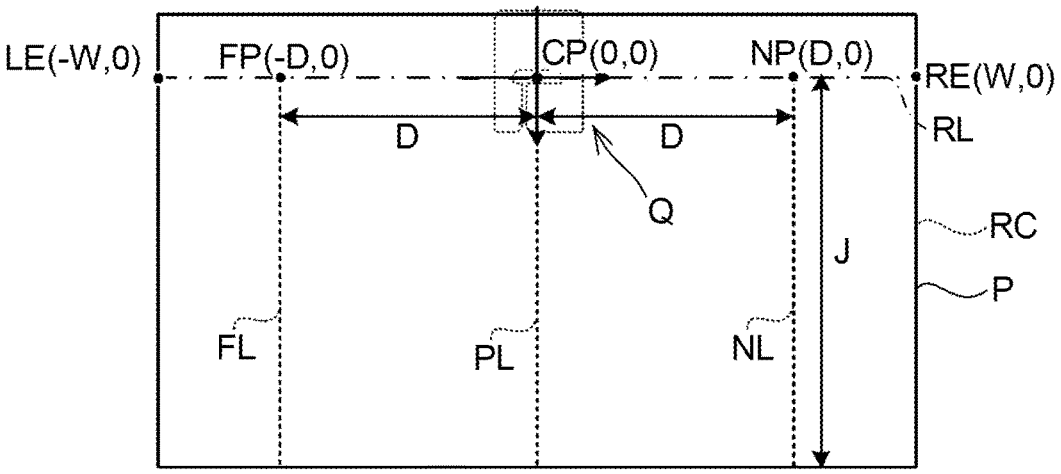
FIGS. 6A-6C are diagrams of processes for generating a projection image P1 to be projected by a projector of the sewing machine.
Figure 6B:
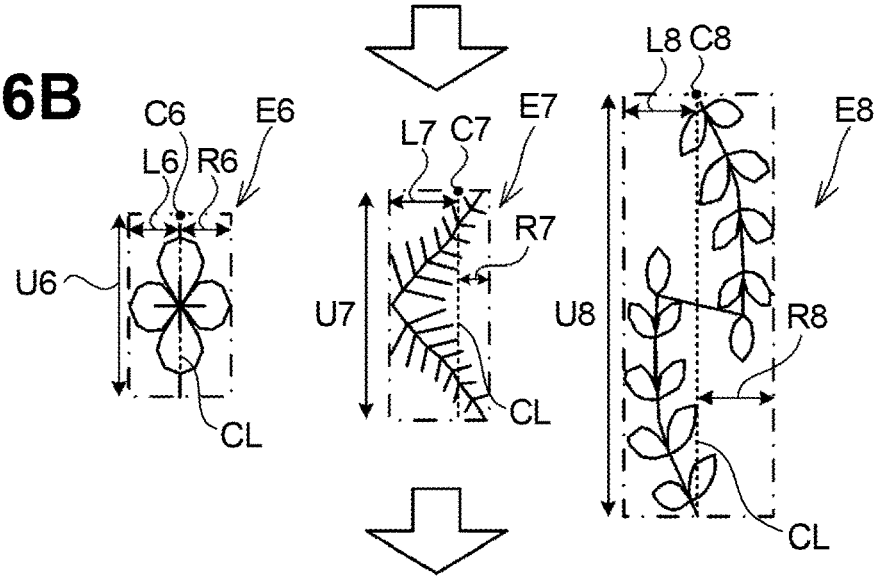

The controller 2 determines whether a pattern has been designated (S4). The user performs a panel operation to designate one of the sewing images of the patterns displayed in the display section 71 of the screen 70. For example, when the controller 2 receives an input to designate a pattern with its ID "7" among the multiple patterns displayed in the LCD 15 (S4: YES), the controller 2 determines, based on the received input, a pattern E7 with its pattern ID "7" as a first pattern (S5). The controller 2 retrieves the pattern data of the first pattern E7 determined at S5, from the flash memory 84, thereby obtaining the size of the pattern determined at S5 (S6). For example, the size of the pattern may be represented by dimensions in the X and Y directions in an embroidery coordinate system. The dimension of a pattern in the X direction may be represented by a length from the middle baseline CL, which is a reference position of a pattern, to an end of the pattern in the X direction. As depicted in FIG. 6B, as the size of the first pattern E7, the controller 2 obtains dimensions L7 and R7 from the middle baseline CL of the first pattern E7 to its respective end in the X direction, as well as a dimension U7 in the Y direction.

The controller 2 causes the LCD 15 to display a screen, such as the screen 70, to show the pattern (e.g., the pattern with its ID "7") determined at S5 (S7). For example, as depicted in FIG. 5, the controller 2 causes the LCD 15 to change the color of the background of the sewing image of the pattern with its ID "7" shown in the display section 71 and to show the sewing image of the pattern with its ID "7" in the display section 72. The controller 2 obtains an initial position of a first image of the first pattern and an initial position of a second image of a second pattern on a projection image. The first image represents a sewing image of the first pattern in a sewing expected size. The sewing expected size refers to a size of a pattern expected to be sewn based on its pattern data. The sewing image in the sewing expected size may be obtained, for example, by converting, based on the pattern data, coordinates of stitches represented in the world coordinate system into coordinates represented in the projected coordinate system. Depending on sewing conditions, the stitches may shrink or puckered, so that the sewing expected size may not be exactly the same as the size of the pattern to be actually sewn, but may have 0-10% difference relative to the size of the pattern to be actually sewn. The first image is a sewing image disposed to an upstream side (e.g., to the front side) in the first direction relative to a virtual line RL as depicted in FIG. 6A. The virtual line RL extends, in the projection image, in a direction orthogonal to the first direction and passes through a needle drop position in the first direction.

The controller 2 obtains initial positions of the first image and the second image represented by coordinates in the projected coordinate system. Settings of the projected coordinate system may be determined appropriately. As depicted in FIG. 6A, a projected coordinate system Q has an origin CP (0,0) located on the needle plate 4 at a position corresponding to the center needle drop position of the needle bar 6, and the right side from the origin CP is defined as an X direction (+) and the front side from the origin CP is defined as a Y direction (+). The center needle drop position of the needle bar 6 refers to a drop position of the needle 7 attached to the needle bar 6. The initial position of the first image in the width direction is located at a position corresponding to a position of the first pattern with its reference position matching or aligning with a reference position of a projection image. In one example, the initial position of the first image in the width direction is located at a position corresponding a position of the first pattern with its reference position, e.g., the middle baseline CL, matching or aligning with the center needle drop position of the needle bar 6 or a line PL that extends from the origin CP in the Y direction. The projection image in the illustrative embodiment includes a first image and two second images. The two second images include sewing images of two patterns, one of which has a pattern ID immediately before the pattern ID of the first pattern, and the other one of which has a pattern ID immediately after the pattern ID of the first pattern. Each initial position of the second images in the width direction is located at a position corresponding to a position of the respective second pattern with its reference position matching or aligning with a position spaced by a predetermined value D in the width direction from the reference position of the projection image. In one example, the initial position of the second image in the width direction is located at a position corresponding to a position of the second pattern with its reference position, e.g., the middle baseline CL, matching or aligning with a position spaced by the predetermined value D from the center needle position of the needle bar 6. More specifically, an initial position, in the width direction, of a second image of a second pattern, whose pattern ID is immediately before the pattern ID of the first pattern, is located at a position corresponding to a position of the second pattern with its reference point CN (wherein N denotes a pattern ID) on the middle baseline CL of the second pattern matching with a reference point FP (−D, 0) on a line FL that is spaced to the left from the center needle drop position of the needle bar 6 (or the line PL) by the predetermined value D. An initial position, in the width direction, of a second image of a second pattern, whose pattern ID is immediately after the pattern ID of the first pattern, is located at a position corresponding to a position of the second pattern with its reference point CN on the middle baseline CL of the second pattern matching with a reference point NP (D, 0) on a line NL that is spaced to the right from the center needle drop position of the needle bar 6 (or the line PL) by the predetermined value D. The predetermined value D may be determined appropriately, based on the size of the projection area RC, the number of sewing images to be included in a projection image, and a moving range of the needle bar 6 configured to be moved by the swing mechanism 57. The predetermined value D is greater or wider than the moving range of the needle bar 6 moved by the swing mechanism 57. For example, the predetermined value D is a fifth to a half of the length (e.g., a longer dimension) of the projection area RC, and approximately 4.3 cm in the illustrative embodiment. The left and right ends of a projection image P in the virtual line RL are LE (−W, 0) and RE (W, 0), respectively. In the illustrative embodiment, the center of the projection image P in the width direction corresponds to the center needle drop position of the needle bar 6.

Figure 7A:
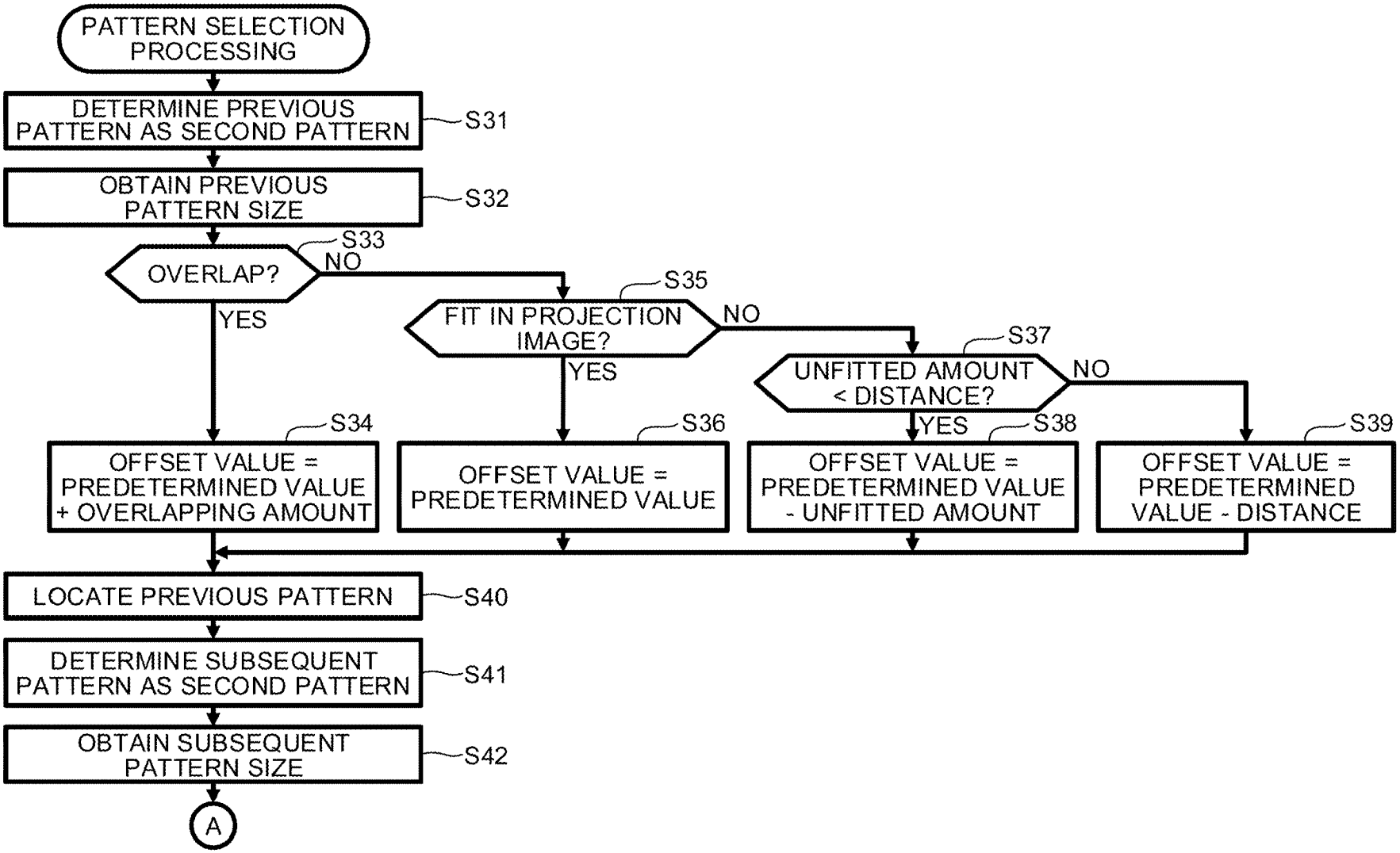
FIGS. 7A and 7B are flowcharts of a pattern selection processing to be performed in the main processing.
Figure 7B:
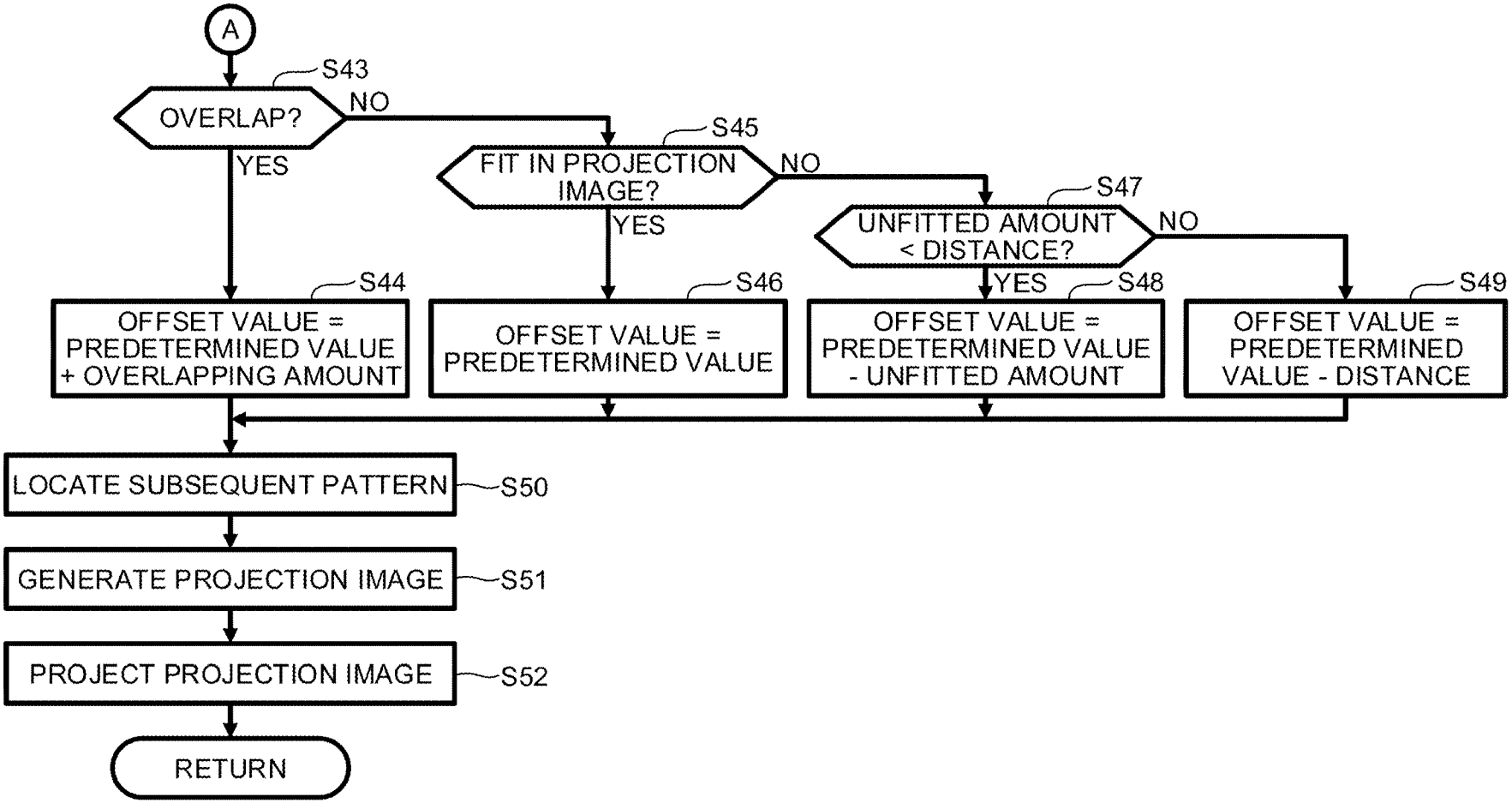

The controller 2 executes a pattern selection processing (S9). Referring to FIGS. 7A and 7B, the pattern selection processing will be briefly described. In this processing, the controller 2 determines, as second patterns, a pattern with its ID immediately before and after the pattern ID of the first pattern determined at S5 (S31 or S41). The controller 2 determines where to locate the first image and the second images in the projection image (S33-S40 or S43-S50), based on the size of the second pattern (S32 or S42), the size of the first pattern obtained at S6, and the initial positions obtained at S8.

For example, if the controller 2 determines that the first image located at its initial position in the sewing expected size overlaps, in the width direction, with a particular second image (of a pattern determined at S31 or S41) located at its initial position (S33: YES or S43: YES), the controller 2 sets an offset value to a value obtained by adding, to the predetermined value D, an overlapping amount G, which is an amount that the second image overlaps with the first image in the width direction (S34 or S44). The offset value represents a distance from the center needle drop position of the needle bar 6, which is a reference to locate the first image, to the middle baseline CL of the second pattern, which is a reference to locate the second image. Based on the result obtained at S34 or S44, the controller 2 locates the first image at its initial position obtained at S8, and locates the particular second image at a position away from the first image in the width direction by the overlapping amount G relative to the initial position of the particular second image obtained at S8 (S40 or S50).

For example, if the controller 2 determines that the first image located at its initial position in the sewing expected size does not overlap with the particular second image located at its initial position (S33: NO or S43: NO), and that the particular second image fits in the projection image (S35: YES or S45: YES), the controller 2 sets an offset value to the predetermined value D and locates the first image and the particular second image to their respective initial positions.

If the controller 2 determines that the first image located at its initial position in the sewing expected size does not overlap with the particular second image located at its initial position (S33: NO or S43: NO); that the particular second image does not fit in the projection image but extends off the projection image (S35: NO or S45: NO); and that an unfitted amount F (e.g., an amount that does not fit in the projection image in the width direction) of the particular second image is shorter than a distance T between the first image and the second image (S37: YES or S47: YES), the controller 2 sets an offset value to a value obtained by subtracting the unfitted amount F from the predetermined value D (S38 or S48). Based on the result obtained at S38 or S48, the controller 2 locates the first image at its initial position obtained at S8, and locates the particular second image at a position closer to the first image in the width direction by the unfitted amount F relative to the initial position of the particular second image obtained at S8 (S40 or S50). If the controller 2 determines that the unfitted amount F of the particular second image is not shorter than the distance T between the first image and the second image (S37: NO or S47: NO), the controller 2 sets an offset value to a value obtained by subtracting the distance T from the predetermined value D (S39 or S49). Based on the result obtained at S39 or S49, the controller 2 locates the first image at its initial position obtained at S8, and locates the particular second image at a position closer to the first image in the width direction by the distance T relative to the initial position of the particular second image obtained at S8 (S40 or S50).

In an example case where the pattern E7 is determined as a first pattern at S5, the controller 2 determines, as a second pattern, a pattern E6 whose pattern ID is immediately before the pattern ID of the pattern E7 (S31). As the size of the second pattern E6, the controller 2 obtains, similarly to S6, dimensions L6 and R6 (as depicted in FIG. 6B) from the middle baseline CL of the second pattern E6 to its respective ends in the X direction, as well as a dimension U6 in the Y direction (S32).

The controller 2 determines whether the first image H7 of the first pattern E7 (determined at S5) located at its initial position (obtained at S8) in the sewing expected size overlaps with the second image H6 of the second pattern E6 (determined at S31) located at its initial position (obtained at S8) in the sewing expected size (S33). On the line RL, the left end (−L7, 0) of the first image H7 at its initial position is located to the right of the right end (−D+R6, 0) of the second image H6 (S33: NO). Subsequently, the controller 2 determines whether the second image H6 located at its initial position, which is obtained at S8, fits in the projection image in the width direction (S35). On the line RL, the left end (−D—L6, 0) of the second image H6 at its initial position is located to the right of the left end (−W, 0) of the projection area RC, so that the controller 2 determines that the second image H6 fits in the projection image in the width direction (S33: YES). The controller 2 sets an offset value to the predetermined value D (S36). The controller 2 locates the first image H7 of the first pattern E7 determined at S5, at the initial position of the first image H7 obtained at S8, and the second image H6 of the second pattern E6 determined at S31 at the initial position of the second image H6 obtained at S8 (S40). In one example, the first image H7 is located at a position corresponding to a position of the first pattern E7 with its reference point C7 matching with the origin CP on the center needle drop position of the needle bar 6, and the second image H6 is located at a position corresponding to a position of the second pattern E6 with its reference point C6 matching with the reference point FP (−D, 0). If the dimension U7 of the first image H7 is shorter than a dimension J in the first direction (e.g., Y direction) from the virtual line RL to the front end of the projection area RC, the controller 2 locates the first image H7 sequentially or repeatedly toward the upstream side in the first direction (e.g., front side) from the line RL, whose position in the first direction corresponds to a needle drop position of the needle bar 6. In another embodiment, the controller 2 may not repeatedly locate the first image H7 but may locate a single first image H7 at a position corresponding to the needle drop position. If the dimension U6 of the second image H6 is shorter than the dimension J, the controller 2 locates the second image H6 sequentially or repeatedly toward the upstream side in the first direction from the line RL, whose position in the first direction corresponds to a needle drop position of the needle bar 6. The image may be sequentially or repeatedly located with reference to the same straight reference line.

Similar to S31-S40, the controller 2 determines a pattern E8 as a second pattern (S41). Similar to S6, as a size of the second pattern E8, the controller 2 obtains dimensions L8 and R8 from the middle baseline CL of the second pattern E8 to its respective end in the X direction, as well as a dimension U8 in the Y direction (S42). The controller 2 may determine that the first image H7 and the second image H8 located at their respective initial positions obtained at S8 do not overlap with each other in the width direction (S43: NO). Subsequently, the controller 2 may determine that the second image H8 fits in the projection image in the width direction (S45: YES). In such case, the controller 2 sets an offset value to the predetermined value D (S46). Based on the setting of the offset value, the controller 2 locates, similar to S40, the first image H7 and the second image H8 at their respective initial positions obtained at S8 (S50).

Figure 6C:
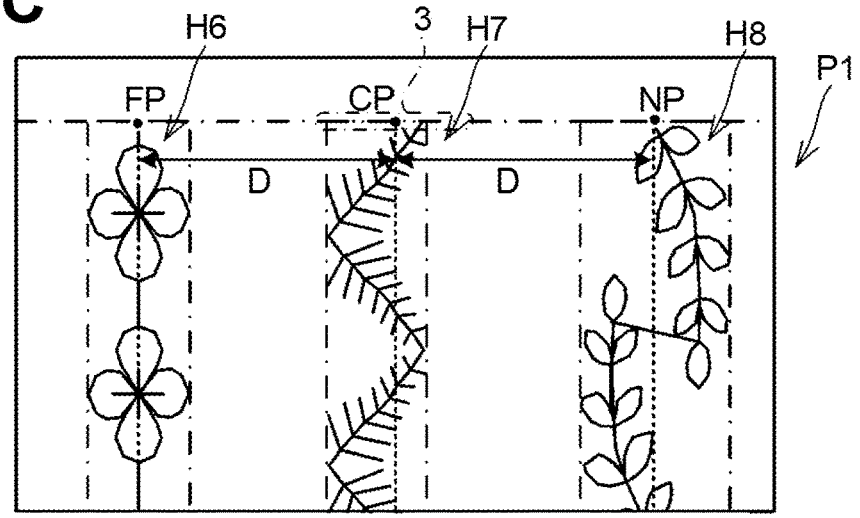

The controller 2 generates a projection image P1 including the first image H7 of the first pattern E7 determined at S5 (S51). The projection image P1 also includes the second images H6 and H8 in their sewing expected sizes. The controller 2 sets the brightness of the second images H6 and H8 in the projection image P1 to a value lower than the brightness of the first image H7. The background color of the projection image P1 may be determined appropriately and may be, for example, white, gray, or black. FIG. 6C shows an example of the projection image P1 generated by the controller 2. The first image H7 is located at a position of the projection image P1 corresponding to a position of the first pattern E7 with its reference point C7 matching with the origin CP on the center needle drop position of the needle bar 6, and a plurality of first images H7 is located in the first direction. The second image H6 is located at a position of the projection image P1 corresponding to a position of the second pattern E6 with its reference point C6 matching with the reference point FP (−D, 0), and a plurality of second images H6 is located in the first direction. The second image H8 is located at a position of the projection image P1 corresponding to a position of the second pattern E8 with its reference point C8 matching with the reference point NP (D, 0), and one second image H8 is located in the first direction. Each of the first image and the second image may be repeatedly located to a predetermined position (e.g., an end in the Y direction (+)) in the projection image. The controller 2 causes the projector 58 to project the projection image P1 generated at S51 (S52). The first image H7, and the second images H6 and H8 are projected in their sewing expected sizes. The first image H7 may be projected at a position where stitches are to be formed. The second images H6 and H8 are projected at positions spaced in the width direction from the position where stitches are to be formed. The first image H7, and the second images H6 and H8 are spaced from one another in the width direction. The controller 2 ends the pattern selection processing and returns to the main processing in FIG. 4.

Figure 8A:
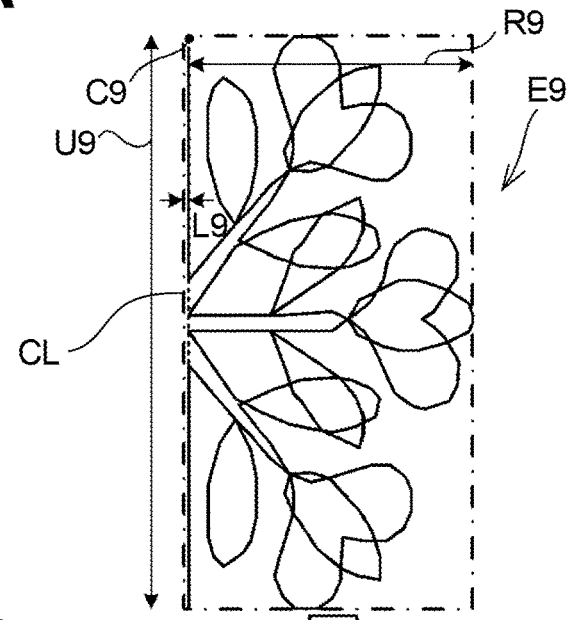
FIGS. 8A-8C are diagrams of processes for generating a projection image P2 to be projected by the projector.

Subsequent to S9 in FIG. 4, if the controller 2 determines that the input key 75 is not selected or pressed at S19 (S19: NO), the flow returns to S4. If the controller 2 determines that a panel operation is performed to select any one of the patterns displayed in the display section 71 (S4: YES), or one of the input keys 73 and 74 (S4: NO, S10: YES), the controller 2 determines a first pattern corresponding to the panel operation (S5). If the controller 2 determines that the input key 73 is selected, the controller 2 determines, as a first pattern, a pattern with its ID immediately before the pattern ID of the pattern currently being determined as a first pattern. In the example case where the pattern E7 is currently determined as a first pattern, if the controller 2 determines that the input key 74 is selected (S10: YES), the controller 2 determines, as a first pattern, the pattern E8 with its ID immediately after the pattern ID of the pattern E7 (S5). Subsequently, at S31, which is included in S9, the controller 2 determines, as a second pattern, the pattern E7 (S31) and another pattern E9 (S41). As depicted in FIG. 8A, as the size of the second pattern E9, the controller 2 obtains dimensions L9 and R9 from a middle baseline CL of the pattern E9 to its respective end in the X direction, as well as a dimension U9 in the Y direction (S42).

Figure 8B:
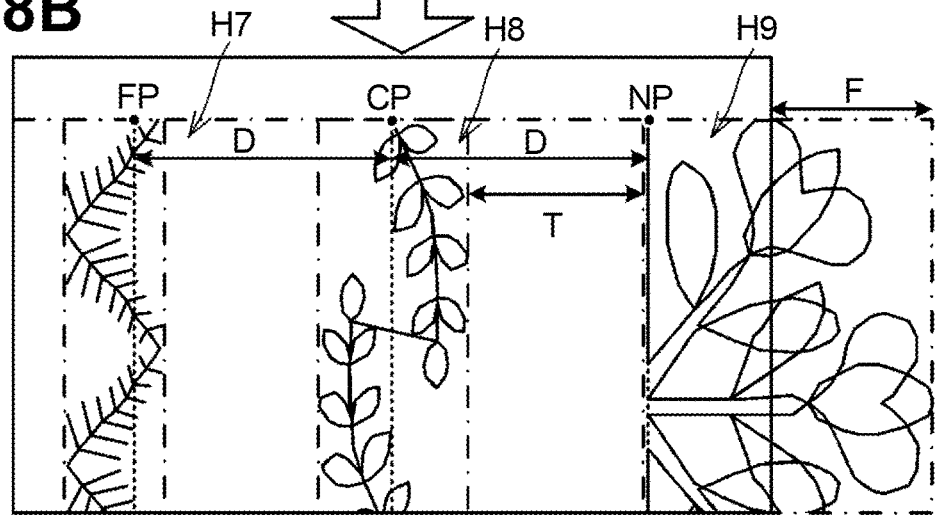

In an example depicted in FIG. 8B, the controller 2 determines that the first image H8 and the second image H9 located at their respective initial positions obtained at S8 do not overlap with each other in the width direction (S43: NO) and that the second image H9 does not fit in the projection image (S45: NO). On the line RL, the right end (D+R9, 0) of the second image H9 at its initial position is located to the right of the right end (W, 0) of the projection image. In this case, the controller 2 determines whether the distance T in the width direction between the first image H8 and the second image H9 is greater than the unfitted amount F of the second image H9 in the width direction (S47). The distance T in the width direction between the first image H8 and the second image H9 may be, for example, a distance on the line RL between the right end (R8, 0) of the first image H8 and the left end (D—L9, 0) of the second image H9. The unfitted amount F may be, for example, a distance on the line RL between the right end (D+R9, 0) of the second image H9 and the right end (W, 0) of the projection image.

Figure 8C:
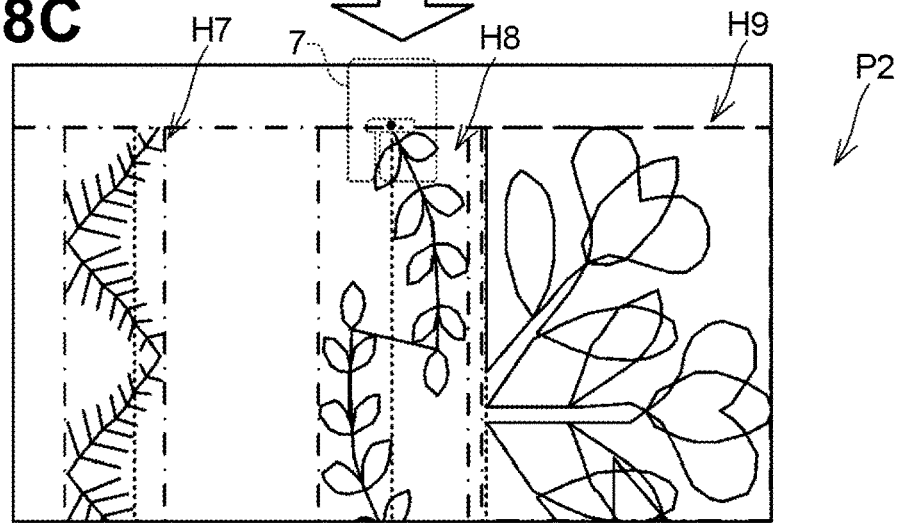

In an example shown in FIG. 8B, the controller 2 determines that the distance T is greater than the unfitted amount F (S47: YES). In this case, the controller 2 sets the offset value to a value obtained by subtracting the unfitted amount F from the predetermined value D (S48). The controller 2 locates the first image H8 at its initial position, which corresponds to a position of the first pattern E8 with its reference point C8 matching with the origin CP on the center needle drop position of the needle bar 6, and locates the second image H9 at a position corresponding to a position of the second pattern E9 with its reference point C9 matching with a point (W−R9, 0) on the line RL (S50). As depicted in FIG. 8C, the controller 2 generates a projection image P2 including the first image H8 and the second images H7 and H9 that are located based on S40 and S50 (S51). The controller 2 causes the projector 58 to project the projection image P2 (S52). In the projection image P2, the first image H8, and the second images H7 and H9 are spaced from one another in the width direction and fit in the projection image P2 in the width direction. The controller 2 ends the pattern selection processing and returns to the main processing in FIG. 4.

Figure 9A:
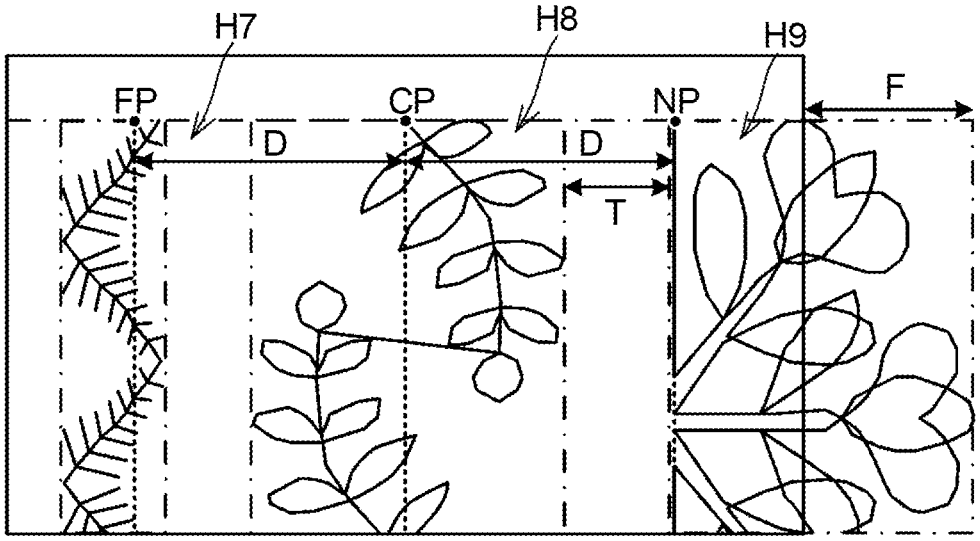
FIGS. 9A and 9B are diagrams of processes for generating a projection image P7 to be projected by the projector.
Figure 9B:
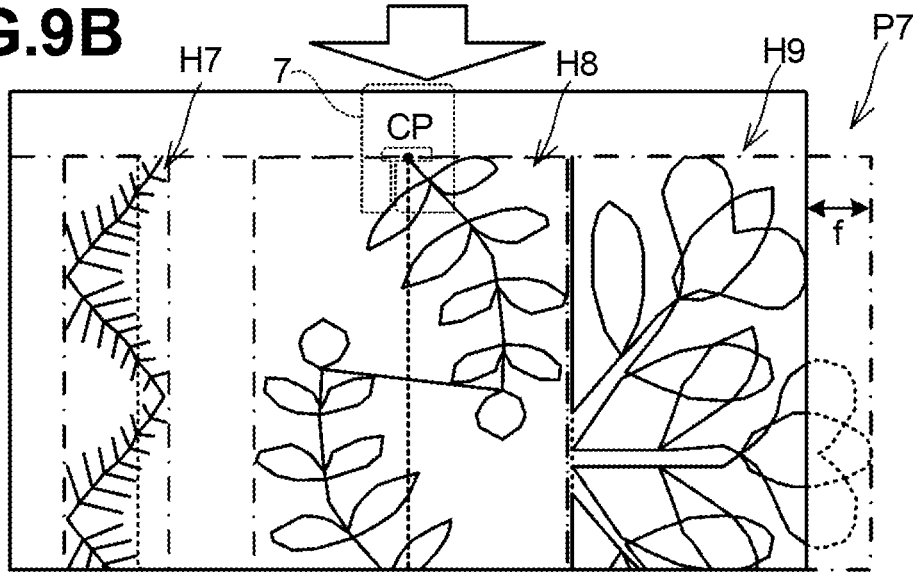

In an example case as depicted in FIG. 9A, the dimension of the first image H8 in the width direction is longer than that of the first image H8 shown in FIG. 8B. In this case, the controller 2 determines that the unfitted amount F is not shorter than the distance T (S47: NO). Subsequently, the controller 2 sets the offset value to a value obtained by subtracting the distance T from the predetermined value D (S49). The controller 2 locates the first image H8 at its initial position, which corresponds to a position of the first pattern E8 with its reference point C8 matching with the origin CP on the center needle drop position of the needle bar 6, and locates the second image H9 at a position corresponding to a position of the second pattern E9 with its reference point C9 matching with a point (R8+L9, 0) on the line RL (S50). As depicted in FIG. 9B, the controller 2 generates a projection image P7 including the first image H8 and the second images H7 and H9 that are located based on S40 and S50 (S51). The controller 2 causes the projector 58 to project the projection image P7 (S52). In the projection image P7, the first image H8 and the second image H7 are spaced from each other in the width direction and fit in the projection image P7 in the width direction. In the projection image P7, the right end of the first image H8 is in the same position in the width direction as the left end of the second image H9, and a right end portion of the second image H9 does not fit in the projection image P7. An unfitted amount f of the second image H9, which is an amount that does not fit in the projection image P7 in the width direction, is smaller than the unfitted amount F, as depicted in FIG. 9A. The controller 2 ends the pattern selection processing and returns to the main processing in FIG. 4.

Figure 10A:
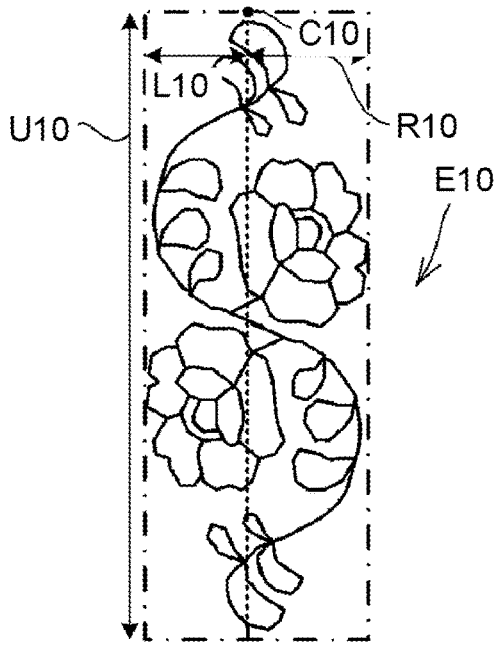
FIGS. 10A-10C are diagrams of processes for generating a projection image P3 to be projected by the projector.

Subsequent to S9 in FIG. 4, if the controller 2 determines that the input key 75 is not selected or pressed at S19 (S19: NO), the flow returns to S4. In the example case where the pattern E8 is currently determined as a first pattern, if the controller 2 determines that the input key 74 is selected (S10: YES), the controller 2 determines, as a first pattern, a pattern E9 with its ID immediately after the pattern ID of the pattern E8 (S5). Subsequently, at S31, which is included in S9, the controller 2 determines, as a second pattern, the pattern E8 (S31) and another pattern E10 (S41). As depicted in FIG. 10A, as the size of the second pattern E10, the controller 2 obtains dimensions L10 and R10 from the middle baseline CL of the second pattern E10 to its respective end in the X direction, as well as a dimension U10 in the Y direction (S42).

Figure 10B:
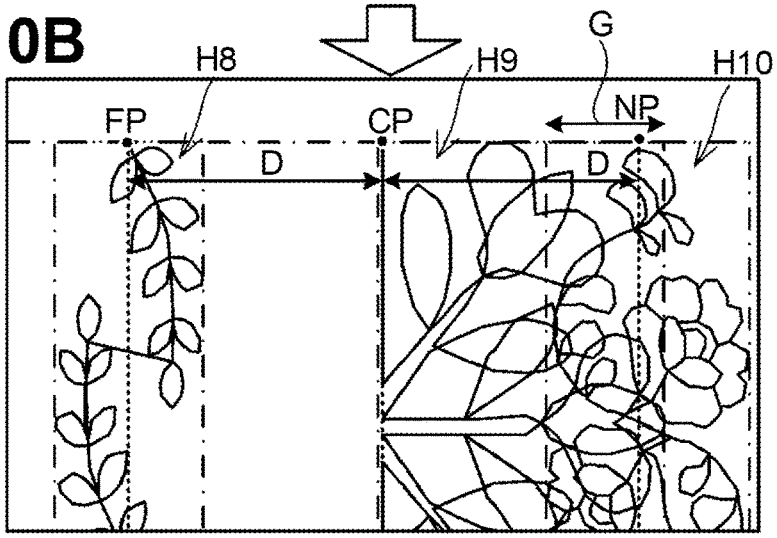
Figure 10C:
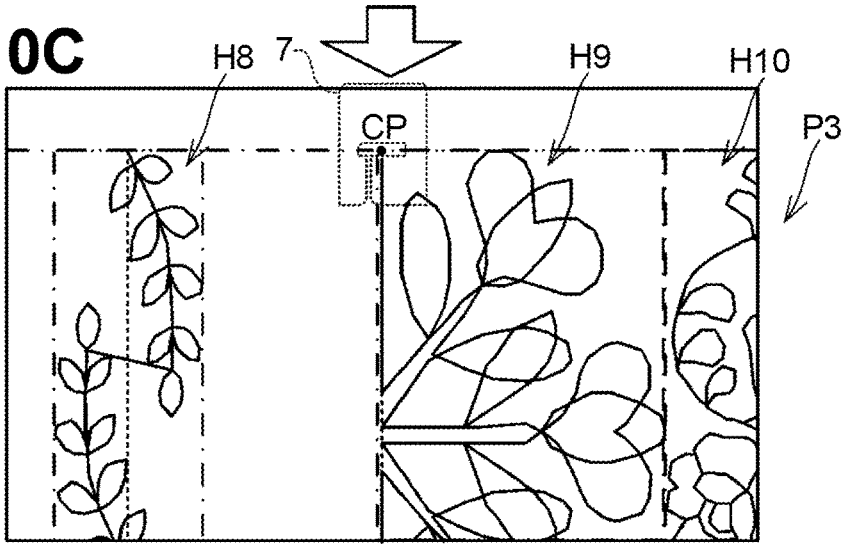

In an example as depicted in FIG. 10B, the controller 2 determines that the first image H9 and the second image H10 located at their respective initial positions obtained at S8 overlaps with each other in the width direction (S43: YES). On the line segment RL, the left end (D−L10, 0) of the second image H10 at its initial position is located to the left of the right end (R9, 0) of the first image H9. In this case, the controller 2 sets the offset value to a value obtained by adding, to the predetermined value D, the overlapping amount G, which is an amount that the second image H10 overlaps with the first image H9 in the width direction (S44). The overlapping amount G may be, for example, a distance on the line RL between the left end (D−L10, 0) of the second image H10 and the right end (R9, 0) of the first image H9. Based on the offset value set at S44, the controller 2 locates the second image H10 at a position corresponding to a position of the second pattern E10 with its reference point C10 matching with a point (D+G, 0) on the line RL (S50). As depicted in FIG. 10C, the controller 2 generates a projection image P3 including the first image H9 and the second images H8 and H10 that are located based on S40 and S50 (S51). The controller 2 causes the projector 58 to project the projection image P3 (S52). In the projection image P3, the first image H9, and the second images H8 and H10 are spaced from one another in the width direction. The second image H8 fits in the projection image P3 in the width direction but the second image H10 extends off the projection image P3 in the width direction. The controller 2 ends the pattern selection processing and returns to the main processing in FIG. 4.

Figure 11A:
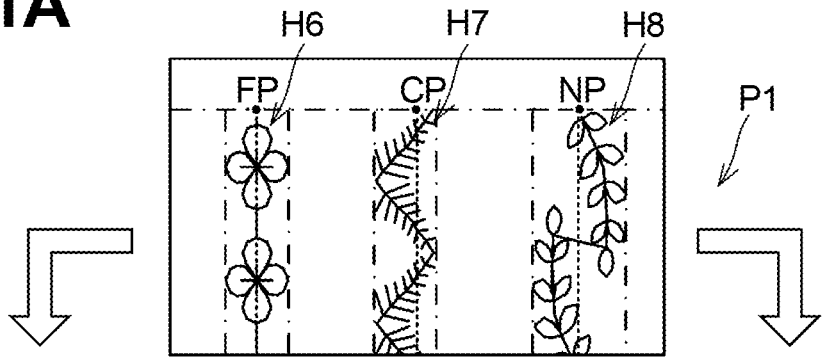
FIGS. 11A-11E are diagrams of processes for generating, based on a projection image P4, a projection image P6 to be projected by the projector.
Figure 11B:
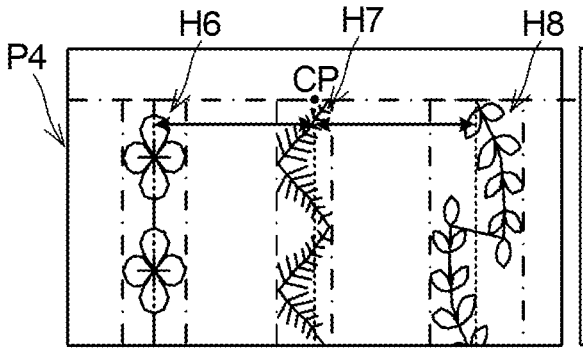
Figure 11C:
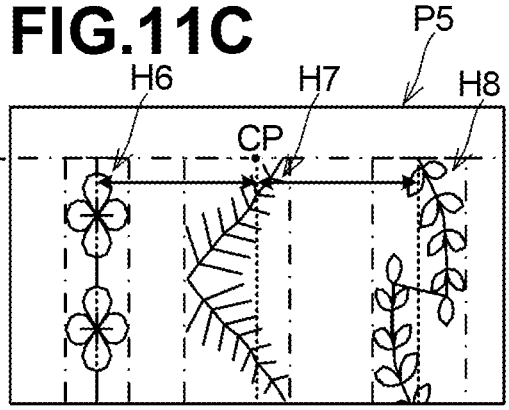

If the controller 2 determines that the input key 77 or 78 is selected or pressed while the projection image Pb, as depicted in FIG. 11A, is projected (S11: YES), the controller 2 determines the size of the first pattern corresponding to an amount of the width/length designated by the input key 77 or 78 (S12). The controller 2 causes the LCD 15 to change the indication of the width/length of the pattern on the screen 70 in accordance with the amount determined at S12. Additionally, the controller 2 causes the LCD 15 to display, in the display section 72, the pattern whose size has been changed (S13). The controller 2 corrects the pattern data of the first pattern E7 based on the amount determined at S12 (S14). The controller 2 executes steps similar to S8 and S9, and causes the projector 58 to project a projection image including the first image H7 of the first pattern E7 in the sewing expected size as determined at S12, and the second images H6 and H8 (S52). For example, if the size of the first pattern E7 is reduced in the X direction and the Y direction (S11: YES), the controller 2 generates a projection image P4 including the first image H7 of the first pattern E7 in the sewing expected size as determined at S12, and the second images H6 and H8 (S51), as depicted in FIG. 11B. The controller 2 causes the projector 58 to project the projection image P4 (S52). For example, if the size of the first pattern E7 is enlarged in the X direction and the Y direction (S11: YES), the controller 2 generates a projection image P5 including the first image H7 of the first pattern E7 in its sewing expected size as determined at S12, and the second images H6 and H8 (S51), as depicted in FIG. 11C. The controller 2 causes the projector 58 to project the projection image P5 (S52). The controller 2 ends the pattern selection processing and returns to the main processing in FIG. 4.

If the controller 2 determines that the input key 76 is selected or pressed (S4: NO, S10: NO, S11: NO, S15: YES), the controller 2 determines a designated color (S16). In the illustrative embodiment, colors of the first image, the second image, and the background of the images may be changed to a color designated by a user. The controller 2 generates a projection image in which a color of the first image, the second image, and/or the background of the images that are currently being projected has been changed to the color designated at S16 (S17). The controller 2 causes the projector 58 to project the generated projection image (S18).

Figure 11D:
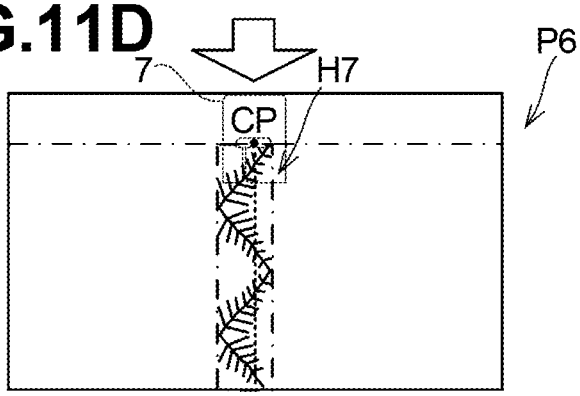
Figure 11E:
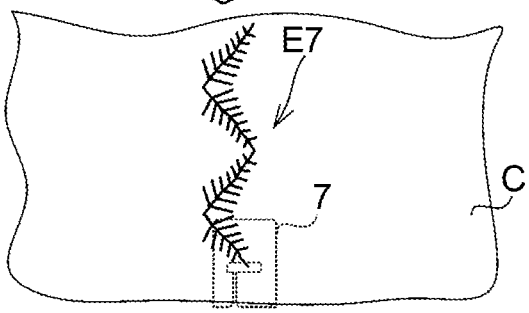

If the controller 2 determines that the input key 76 is not selected while the projection image P4 is being projected (S15: NO), but the input key 75 is selected (S19: YES), the controller 2 generates a projection image P6 that includes the first image H7 but does not include the second images H6 and H8, as depicted in FIG. 11D. The controller 2 causes the projector 58 to project the generated projection image P6 (S20). The controller 2 waits for an input of a start instruction to start sewing the first pattern E7 (S25: NO). The start instruction may be input by pressing the start/stop switch 29. If the controller 2 determines that the start instruction is input (S25: YES), the controller 2 causes the projector 58 to end the projection of the first image (S21). The controller 2 causes the feed unit 21 and the sewing unit 30 to start sewing the first pattern E7 (e.g., form stitches for the first pattern E7) on the workpiece C based on the pattern data of the first pattern E7 (S22). If the size of a pattern is changed, as depicted in FIG. 11D, using the input key 77 and/or 78 (S11: YES, S12), the controller 2 causes the feed unit 21 and the sewing unit 30 to sew the first pattern E7, as depicted in FIG. 11E, based on the pattern data corrected at S14 (e.g., in a size as changed at S14). The controller 2 causes the feed unit 21 and the sewing unit 30 to continue sewing until the controller 2 determines that a stop instruction to stop sewing is input (S23: NO). The stop instruction may be input by pressing the start/stop switch 29. If the controller 2 determines that the stop instruction is input (S23: YES), the controller 2 causes the sewing unit 30 to stop sewing the first pattern E7. The controller 2 thus ends the main processing.

The sewing machine 1 includes the feed unit 21 configured to feed a workpiece C with the feed dog 24, and is configured to project a projection image representing a pattern including pieces of a design that are sequentially or repeatedly arranged in the first direction. The design includes a plurality of line segments, at least one of which extends in a direction crossing the first direction. The sewing machine 1 allows a user to preview or check before sewing, a sewing image of the first pattern projected in its sewing expected size. The sewing machine 1 may thus provide increased convenience to a user for sewing stitch patterns.

The controller 2 may receive an instruction to designate the size of the first pattern (S11). The controller 2 generates a projection image including the first image of the first pattern in its sewing expected size as instructed (S51). The sewing machine 1 may project the first image of the first pattern in a size as designated by a user. If the user changes the size of a pattern as depicted in FIG. 11B or 11C, the user can preview or check before sewing, a sewing image of the first pattern projected in the sewing expected size. While previewing or checking the size of the first image projected on the workpiece C, the user may change and determine the size of the first pattern.

As a second pattern, the controller 2 determines, from multiple patterns arranged in a predetermined order (e.g., based on a pattern ID), a pattern which is before and after, with respect to the predetermined order, the first pattern determined at S5 (S31, S41). The predetermined order may be the order of the numbers of the pattern IDs. The controller 2 may generate a projection image including the first image and the second images (S51). The controller 2 causes the projector 58 to project the generated projection image (S52). The sewing machine 1 may project a projection image including the first image and the second images. This may provide increased convenience to a user for selecting a stitch pattern. For example, the user is allowed to select a pattern while viewing a sewing image, projected on the workpiece C, of a pattern that the user has selected, as well as sewing images of other patterns whose pattern IDs are immediately before and after the pattern ID of the selected pattern.

The controller 2 may receive an instruction to change a first pattern in accordance with the predetermined order (S10). The controller 2 determines a first pattern (S5) again from the multiple patterns, and determines, as a second pattern, a pattern which is before and after the first pattern with respect to the predetermined order (e.g., the patterns ID) (S31, S41). Based on the instruction received at S10, the sewing machine 1 may selectively project a first image and second images in accordance with the predetermined order. The sewing machine 1 may thus provide increased convenience to a user for selecting a stitch pattern.

The controller 2 may generate a projection image including the first image, as well as the second images in their sewing expected sizes (S51). The controller 2 causes the projector 58 to project the generated projection image (S52). The sewing machine 1 may project a projection image including the first image and the second images, each in a sewing expected size.

The controller 2 may generate a projection image including a first image, and second images that are located at positions where the second images do not overlap with the first image in the width direction (e.g., the second direction) orthogonal to the first direction (S51). The controller 2 causes the projector 58 to project the generated projection image (S52). The sewing machine 1 may project, for example, the projection image P3, as depicted in FIG. 10C, including the first image H9 and the second image H10 that are more readily distinguishable by a user than the projection image, as depicted in FIG. 10B, in which the first image H9 and the second image H10 are overlapping. The sewing machine 1 may thus provide increased convenience to a user for selecting a stitch pattern.

The controller 2 obtains an initial position of the first image and an initial position of the second image on a projection image (S8). The controller 2 determines whether the second image located at its initial position obtained at S8 overlaps with the first image located at its initial position obtained at S8 (S33, S43). For example, as depicted in FIG. 6C, if the controller 2 determines that the first image H7 and the second image H6 (H8) does not overlap with each other in the width direction (S33: NO, S43: NO), the controller 2 locates the first image H7 at its initial position and the second image H6 (H8) at its initial position (S36, S40, S46, S50). For example, as depicted in FIG. 10B, if the controller 2 determines that the first image H9 and the second image H10 overlap with each other in the width direction (S33: YES, S43: YES), the controller 2 locates the first image H9 at its initial position obtained at S8, and locates the second image H10, relative to its initial position obtained at S8, at a position away from the first image H9 in the width direction (e.g., toward the right) (S44). The controller 2 generates a projection image (S51) including the first image, and the second images that are located at positions as determined (S40, S50). The controller 2 causes the projector 58 to project the generated projection image (S52). The sewing machine 1 may project a projection image including the first image and the second image that are spaced from each other, with a relatively simple operation, so as not overlap with each other. The sewing machine 1 predefines an initial position of a second image. Unless the second image overlaps with the first image or extends off the projection image, the sewing machine 1 may project the second image at the same position (e.g., the predefined initial position) in the projection area RC, regardless of which pattern is selected as a second pattern.

The initial position of the first image in the width direction is located at a position corresponding to a position of the first pattern with its reference position matching or aligning with a reference position of the projection image. If the controller 2 determines that the first image and the second image overlap with each other in the width direction (S33: YES, S43: YES), the controller 2 locates the second image, relative to its initial position obtained at S8, at a position away from the first image in the width direction by the overlapping amount G (S34, S40, S44, S50). The controller 2 may generate a projection image (S51) including the first image, and the second images that are located at positions as determined (S40, S50). The controller 2 causes the projector 58 to project the generated projection image (S52). The sewing machine 1 may project, for example, the projection image P3, as depicted in FIG. 10C, including the first image H9 and the second image H10 that are more readily distinguishable by a user than the projection image, as depicted in FIG. 10B, in which the first image H9 and the second image H10 are overlapping. The sewing machine 1 may thus provide increased convenience to a user for selecting a stitch pattern.

The controller 2 may determine whether the second image located at its initial position obtained at S8 fits in a projection image (S35, S45). If the controller 2 determines that the second image fits in the projection image (S35: YES, S45: YES), the controller 2 locates the first image and the second image at their respective initial positions obtained at S8 (S36, S46). For example, as depicted in FIG. 8B, if the controller 2 determines that the second image H9 does not fit in the projection image in the width direction but extends off the projection image (S35: NO, S45: NO), the controller 2 locates the first image H8 at its initial position obtained at S8, and locates the second image H9, relative to its initial position obtained at S8, at a position closer to the first image H8 in the width direction so as not overlap with the first image H8 (S38, S40, S48, S50), as depicted in FIG. 8C. The controller 2 generates a projection image P2 (S51) including the first image H8 and the second images H7, H9 that are located as determined (S40, S50). The controller 2 causes the projector 58 to project the generated projection image P2 (S52). The sewing machine 1 may project the projection image P2 (as depicted in FIG. 8C), in which the first image H8 and the second images H7, H9 are each fit in the projection image P2 in the width direction. The sewing machine 1 may thus provide increased convenience to a user for selecting a stitch pattern.

More specifically, as depicted in FIG. 8B, if the controller 2 determines that the second image H9 does not fit in the projection image in the width direction but extends off the projection image (S35: NO, S45: NO), the controller 2 locates the second image H9, relative to its initial position obtained at S8, at a position closer to the first image H8 in the width direction, so as not overlap with the first image H8, such that the unfitted amount F becomes equal to or closer to zero (S38, S40, S48, S50), as depicted in FIG. 8C. The controller 2 generates the projection image P2 (S51) including the first image H8, and the second images H7, H9 that are located at positions as determined (S40, S50). The controller 2 causes the projector 58 to project the generated projection image P2 (S52). The sewing machine 1 may thus project a projection image in which whole or larger portion of a second image is included with a relatively simple operation. The sewing machine 1 predefines an initial position of a second image. Unless the second image overlaps with the first image or extends off the projection image, the sewing machine 1 may project the second image at the same position (e.g., the predefined initial position) in the projection area RC, regardless of which pattern is selected as a second pattern.

The controller 2 may generate a projection image including a first image and a second image whose brightness is lower than the brightness of the first image (S51, S17). The sewing machine 1 may thus project the first image and the second image, in which the first image may be visually distinguishable more readily than the second image. The user may readily distinguish between the first image and the second image based on the brightness of the images.

The controller 2 causes the LCD 15 to display a screen including multiple patterns (S2). The controller 2 may receive an instruction to designate a first pattern from the multiple patterns displayed in the LCD 15 (S4). The controller 2 determines the first pattern from the multiple patterns based on the instruction received at S4 (S5). The sewing machine 1 may provide increased convenience to a user for selecting a first pattern.

While aspects are described in detail with reference to the specific embodiment thereof, this is merely an example, and various changes, arrangements and modifications may be made therein without departing from the spirit and scope of the disclosure. For example, the following modifications may be made.

(A) Configuration of the sewing machine 1 may be modified as desired. The sewing machine 1 may be an industrial sewing machine. The feed unit 21 may be configured to cause the feed dog 24 not to move the workpiece C in the left-right direction. In this configuration, the sewing machine 1 may sew a pattern by causing the swing mechanism 57 to move the needle bar 6 in the width direction (e.g., the left-right direction) as desired. The sewing machine 1 may not necessarily include the swing mechanism 57. For sewing a pattern, the sewing machine 1 may be configured to cause the feed dog 24 to feed the workpiece C in the feed direction (e.g., the front-rear direction) and the width direction (e.g., left-right direction). Examples of an input device may include a keyboard, a mouse, and a joystick, in addition to the touch screen 26. As long as a display is configured to display an image, other display than the LCD 15 may be used. Examples of a display may include an organic EL display, a plasma display, a plasma tube array display, and an electronic paper display that uses electrophoresis. A position where the projector 58 is located may be changed as desired. The projection area RC of the projector 58 may also be changed as desired. Colors that the projector 58 can display may be changed. A display may be omitted as desired. Examples of a storage device may include a removable readable/writable media, and non-removable storage device, in addition to the flash memory 84. Examples of the removable readable/writable media may include a magnetic disk, a magneto-optical disk, an optical disk, and a semiconductor memory. Examples of the non-removable storage device may include a built-in hard disk drive and a solid state drive ("SSD"). Patterns may be obtained or received from a device connected to the sewing machine 1 in a wired or wireless manner.

(B) A program including instructions that causes the controller 2 to perform the main processing of FIG. 4 may be stored in a storage device of the sewing machine 1 before the sewing machine 1 executes the program. A method for obtaining the program, a route through which the program is obtained, and a device that stores the program may be changed as desired. A program to be executed by the controller 2 may be received, via a cable or wireless communication, from another device (e.g., a PC or a server connected to the sewing machine 1 via a network). The received program may be stored in a storage device, such as a flash memory.

(C) The steps of the main processing of the sewing machine 1 are not limited to being executed by the controller 2, but some or all of the steps may be executed by another electronic device (e.g., an ASIC). In some embodiments, the steps of the main processing may be executed by multiple electronic devices (e.g., CPUs). The steps of the main processing may be executed in a different order. A step may be omitted from or added to the main processing. The scope of the disclosure includes such configuration that an operating system (OS) operating on the sewing machine 1 executes some or all of the steps of the main processing based on a command/instruction from the controller 2. For example, the following modifications (C-1) to (C-4) may be added to the main processing.

(C-1) The size, shape, and position of the projection area RC of the projector 58 may be changed as desired. Layout of a screen and types of input keys to be displayed in a display may be changed as desired. The controller 2 may generate a projection image including a first image but not including a second image. The number of second images, and a location and a size of a second image(s) in a projection image may be changed as desired. For example, the controller 2 may be configured to determine a first pattern and a second pattern which is either before or after the first pattern with respect to the predetermined order. The predetermined order may be appropriately set. Examples of the predetermined order may include, other than the pattern ID, the number of stitches of a pattern, a dimension of a pattern in the width/second direction, a dimension of a pattern in the first direction, frequency of use of a pattern, ascending/descending order of the registered order of favorite patterns. The projection image may include an image of an input key, other than a first image and a second image. The sewing machine 1 may include a detector configured to detect that a projected input key is selected by an input device. An example of combination of the detector and the input device may be an ultrasonic receiver and an ultrasonic stylus configured to transmit ultrasound and an electrical signal when a tip of the stylus is pressed. Another example of combination of the detector and the input device may be a capturing device, such as an image sensor, and an optical stylus configured to emit light when a tip of the stylus is pressed. The sewing machine 1 may be configured to execute the main processing based on determining that the projected input key is selected.

(C-2) Steps S11-S14 may be omitted or changed. The controller 2 may be configured not to change the size of the first pattern if receiving an instruction, or to change at least one of the size of the first pattern and the first image based on an instruction.

(C-3) Steps S15-S18 may be omitted or changed. The controller 2 may be configured not to change a background color of a projection image, and colors of the first image and the second image. The controller 2 may be configured to automatically change colors of the background of the projection image, the first image and the second image, based on the types of the first and second patterns (e.g., botanical patterns and geometric patterns) and the color of the workpiece C. The controller 2 may be configured to determine a first pattern and a second pattern at random from multiple patterns.

(C-4) The controller 2 may generate a projection image including a first image, and a second image that may partially overlap with the first image in the width direction, which is perpendicular to the feed direction. In one example, if a dimension of a projection image in the width direction is wide relative to dimensions of a plurality of patterns in the width direction, and when a first image and a second image, which are located at their initial positions, do not overlap with each other nor extend off the projection image, S33-S39 and S43-S49 may be omitted as desired. The controller 2 may not necessarily predefine an initial position of a second image. For example, the controller 2 may locate a second image at a position where the second image does not overlap, in the width direction, with a first image located at its initial position. A manner of setting the initial positions of the first and second images may be changed as desired. For example, a reference of setting initial positions of the first image and the second image may be any of the center needle drop position of the needle bar 6, which is configured to be moved by the swing mechanism 57, and left and right needle drop positions of the needle bar 6 that are respective ends of the moving range of the needle bar 6 in the width direction. The initial position of the second image may be set to a position where an end (e.g., a left end) of the second image in the width direction matches an end (e.g., a right end) of the first image in the width direction. The controller 2 may thus locate the second image at its initial position and may generate a projection image including a first image, and a second image that does not overlap with the first image. The initial position of the second image may be set to a position where an end (e.g., a left end) of the second image in the width direction matches an end (e.g., a left end) of the projection image in the width direction. The controller 2 may thus locate the second image at its initial position and may generate a projection image including a first image, and a second image that does not extend off the projection image.

What is claimed is:

1. A sewing machine, comprising:

a bed;

a feed unit including a feed dog disposed at the bed and configured to drive the feed dog to feed a workpiece in a feeding direction;

a sewing unit configured to form stiches on the workpiece, the stitches representing a pattern;

a projector configured to project a projection image onto a projection area on the bed; and a controller configured to control the feed unit, the sewing unit, and the projector; the controller configured to perform:

generating the projection image including a first image representing a sewing image of a first pattern in the pattern, the first image being to be located toward an upstream side in the feeding direction and a second image representing a sewing image of a second pattern different from the first pattern; and causing the projector to project the generated projection image onto the projection area.

2. The sewing machine according to claim 1, wherein the controller is configured to perform:

determining a pattern from multiple patterns, as the first pattern;

determining a pattern different from the first pattern, as the second pattern; and generating the projection image including the first image and the second image based on the first pattern and the second pattern.

3. The sewing machine according to claim 1, wherein the first image is a sewing image of the first pattern in a sewing expected size of the first pattern, and the second image is a sewing image of the second pattern in a sewing expected size of the second pattern.

4. The sewing machine according to claim 1, wherein the first image is located toward the upstream side in the feeding direction from a position corresponding to a needle drop position located below a needle bar of the sewing unit.

5. The sewing machine according to claim 1, wherein the pattern includes pieces of a predetermined design that are repeatedly arranged in the feeding direction.

6. The sewing machine according to claim 1, wherein the projection area includes a needle drop position.

7. The sewing machine according to claim 1, wherein the controller is configured to perform causing the projector to end the projection of the first image when a start instruction to start sewing the first pattern is input.

8. The sewing machine according to claim 3, wherein the controller is further configured to perform receiving a first instruction for designating the sewing expected size of the first pattern, and the generating the projection image generates the projection image including the first image in the sewing expected size designated by the first instruction.

9. The sewing machine according to claim 1, wherein the controller is further configured to perform receiving a second instruction for changing the first pattern, and the determining a pattern from the multiple patterns as the first pattern determines another pattern from the multiple patterns as the first pattern based on the second instruction.

10. The sewing machine according to claim 1, wherein the controller is further configured to perform receiving a third instruction for designating a color of the first image, and the generating the projection image generates the projection image in the color designated by the third instruction.

11. The sewing machine according to claim 1, wherein the controller is further configured to perform receiving a fourth instruction for designating a color of a background of the sewing image of the first pattern in the projection image, and the generating the projection image generates the projection image including the background of the sewing image in the color designated by the fourth instruction.

12. The sewing machine according to claim 1, wherein the controller is further configured to perform receiving a fifth instruction for designating a color of the second image, and the generating the projection image generates the projection image in the color designated by the fifth instruction.

13. The sewing machine according to claim 1, wherein the projection image includes the first image and the second image arranged side-by-side with the first image in a width direction orthogonal to the feeding direction.

14. The sewing machine according to claim 2, wherein the controller is further configured to perform:

displaying the multiple patterns in the display; and receiving a sixth instruction for designating the first pattern from the multiple patterns displayed in the display, and the determining a pattern from the multiple patterns as the first pattern determines a pattern from the multiple patterns as the first pattern based on the sixth instruction.

* * * * *